US008796620B2

(12) United States Patent
Shaw et al.

(10) Patent No.: US 8,796,620 B2
(45) Date of Patent: Aug. 5, 2014

(54) MASS SPECTROMETRY FOR GAS ANALYSIS WITH A ONE-STAGE CHARGED PARTICLE DEFLECTOR LENS BETWEEN A CHARGED PARTICLE SOURCE AND A CHARGED PARTICLE ANALYZER BOTH OFFSET FROM A CENTRAL AXIS OF THE DEFLECTOR LENS

(75) Inventors: Philip Neil Shaw, Warrington (GB); Jonathan Hugh Batey, Frodsham (GB)

(73) Assignee: MKS Instruments, Inc., Andover, MA (US)

( * ) Notice: Subject to any disclaimer, the term of this patent is extended or adjusted under 35 U.S.C. 154(b) by 43 days.

(21) Appl. No.: 13/155,890

(22) Filed: Jun. 8, 2011

(65) Prior Publication Data

US 2012/0312984 A1 Dec. 13, 2012

(51) Int. Cl.
*H01J 3/14* (2006.01)
*H01J 49/06* (2006.01)

(52) U.S. Cl.
CPC ..... *H01J 49/061* (2013.01); *H01J 49/067* (2013.01); *H01J 49/062* (2013.01)
USPC ..... 250/294; 250/396 R

(58) Field of Classification Search
CPC ..... H01J 49/061; H01J 49/062; H01J 49/067
USPC ..... 250/281, 283, 294, 298, 396 R
See application file for complete search history.

(56) References Cited

U.S. PATENT DOCUMENTS 2,331,189 A * 10/1943 Hipple, Jr. ..... 250/286
2,537,025 A * 1/1951 Berry ..... 250/299
3,678,333 A * 7/1972 Coates et al. ..... 315/382
3,939,344 A 2/1976 McKinney
4,146,787 A 3/1979 Fite
4,481,415 A * 11/1984 Takeda et al. ..... 250/292
4,746,794 A 5/1988 French et al.
5,051,584 A 9/1991 Gray et al.
5,426,301 A * 6/1995 Turner ..... 250/288
5,481,107 A * 1/1996 Takada et al. ..... 250/281

(Continued)

FOREIGN PATENT DOCUMENTS

EP 0237259 3/1987
JP 08007829 1/1996

(Continued)

OTHER PUBLICATIONS

The International Search Report for PCT Application No. PCT/US2012/038275, mailed on Nov. 26, 2012 (5 pgs.).

(Continued)

*Primary Examiner* — Michael Logie
*Assistant Examiner* — Wyatt Stoffa
(74) *Attorney, Agent, or Firm* — Proskauer Rose LLP

(57) ABSTRACT

Apparatus, methods and systems are provided to inhibit a sightline from a charged particle source to an analyzer and for changing a baseline offset of an output spectrum of an analyzer. A supply of charged particles is directed through a hollow body of a deflector lens that is positioned relative to a charged particle source and an analyzer. A flow path along a preferred flow path through a deflector lens permits passage of the ions from the source to the detector while inhibiting a sightline from the detector to the source in a direction parallel to the central longitudinal axis of the deflector lens.

18 Claims, 15 Drawing Sheets

(56) References Cited

U.S. PATENT DOCUMENTS

| | | | | |
|---|---|---|---|---|
| 5,495,107 | A | 2/1996 | Hu et al. | |
| 5,663,560 | A | 9/1997 | Sakairi et al. | |
| 5,672,868 | A | 9/1997 | Mordehai et al. | |
| 6,005,245 | A | 12/1999 | Sakairi et al. | |
| 6,031,379 | A | 2/2000 | Takada et al. | |
| 6,075,243 | A | 6/2000 | Nabeshima et al. | |
| 7,521,673 | B2 * | 4/2009 | Arcas et al. | 250/294 |
| 7,791,042 | B2 * | 9/2010 | McCauley et al. | 250/427 |
| 7,977,649 | B2 * | 7/2011 | Hirano | 250/396 R |
| 2004/0026614 | A1 * | 2/2004 | Bateman et al. | 250/281 |
| 2004/0056190 | A1 | 3/2004 | Buttrill, Jr. | |
| 2008/0116371 | A1 | 5/2008 | Wouters et al. | |
| 2009/0266984 | A1 * | 10/2009 | Hirano | 250/288 |
| 2010/0193677 | A1 * | 8/2010 | Freedman et al. | 250/281 |
| 2012/0312978 | A1 * | 12/2012 | Shaw et al. | 250/282 |

FOREIGN PATENT DOCUMENTS

| | | | |
|---|---|---|---|
| JP | 2004071470 | | 3/2004 |
| JP | 2004071470 | A * | 3/2004 |
| WO | WO/9318540 | | 9/1993 |
| WO | 01/91159 | A1 | 11/2001 |

OTHER PUBLICATIONS

The International Search Report for PCT Application No. PCT/US2012/038272, mailed Dec. 7, 2012 (4 pgs.).

The International Search Report for PCT Application No. PCT/US2012/038271, mailed on Dec. 7, 2012 (4 pgs.).

* cited by examiner

MASS SPECTROMETRY FOR GAS ANALYSIS WITH A ONE-STAGE CHARGED PARTICLE DEFLECTOR LENS BETWEEN A CHARGED PARTICLE SOURCE AND A CHARGED PARTICLE ANALYZER BOTH OFFSET FROM A CENTRAL AXIS OF THE DEFLECTOR LENS

TECHNICAL FIELD

The description generally relates to gas analysis using mass spectrometry where the gas to be measured is residual within a vacuum environment, or the gas has been sampled from a higher pressure into a vacuum chamber. The description also describes charged-particle optics used in mass spectrometry systems to direct beams of charged particles.

BACKGROUND

Charged particle analysis includes identifying a chemical constitution of a substance by separating charged particles (e.g., ions) from the substance and analyzing the separated charged particles. Mass spectrometry is a type of charged particle analysis and generally refers to the measurement of the value of a particle's mass or an implicit determination of the value of the particle's mass by measurement of other physical quantities using spectral data. Mass spectrometry involves determining the mass-to-charge ratio of an ionized molecule or component. When the charge of the ionized particle is known, the mass value of the particle can be determined from a spectrum of mass-to-charge values.

Systems for performing mass spectrometry are usually referred to as mass spectrometers. Mass spectrometer systems generally include an ion source, a mass filter or separator and a detector (e.g., Faraday collector or electron multiplier). For example, a sample of molecules or components can be ionized by electron impact in the ion source to create charged particles. Types of ion sources include, for example, electron-impact, electrospray, microwave, proton transfer reaction, plasma, and/or chemical ionization reaction. Charged particles having different mass values are separated by the mass analyzer into a mass spectrum, for example, by controlled application of electrical or magnetic fields to the charged particles in the filter or separator. Parameters and properties of the filter can determine or select a set of charged particles to be transmitted. For example, the properties of the filter can be such that only particles with a particular mass range traverse the filter to the analyzer. The detector collects the charged particles and communicates with a controller to generate a mass spectrum. The mass spectrum may be displayed, viewed and/or recorded. The relative abundance of mass values in the spectrum is used to determine the composition of the sample (or draw conclusions about the sample) and the mass values or identities of molecules or components of the sample.

A quadrupole mass spectrometer is a type of mass spectrometer that includes a quadrupole mass filter to separate the charged particles based on a mass-to-charge ratio of the charged particles. Quadrupole mass spectrometers are typically designed for known charged particles and known angular acceptance of in-bound charged particles. For high-intensity charged particle sources with solid or liquid sample species, unwanted photons, such as visible-light or x-ray photons and unstable neutral molecules, can be generated by the ion source. These unwanted photons and neutrals can produce or result in error (e.g., noise) in the output spectrum.

In particular, when the detector has a sightline to the ion source, unwanted noise can result from these unwanted photons.

Current attempts to reduce signal error by preventing a sightline between an ion source and a detector or between an analyzer and a detector involve, for example, mounting the detector off-axis relative to the source or analyzer, inserting a baffle or photon stop (e.g., Bessel box) between the detector and the source or analyzer and/or employing a second filter to filter out the unwanted photons. These current systems typically require large quadrupole geometries (e.g., 9 mm or larger rod diameters). Additionally, these attempts typically involve additional field-generating elements or deflector structures to provide electric fields transverse to the direction of the ion beam to divert the ion beams off-axis. The additional field-generating elements can adversely impact ion transmission and/or require specifically-tuned energies, leading to the possibility of errors. The field-generating elements can also adversely affect the ion flow into the detector, resulting in ions entering the detector on a path that is not collimated or aligned with the detector structures. This misalignment results in reduced detection of ions that pass into the detector. Some beam diversion systems operate at high voltages, which can increase cost and risk. Many existing mass spectrometer systems operate at relatively coarse vacuum pressures, typically up to 0.1 Pa. Therefore, in such systems it is desirable to avoid using high voltages due to the risk of electrical arcing and/or general operational safety considerations.

When quadrupole mass spectrometers are used for Residual Gas Analysis (RGA) or analysis of gases which are sampled from a higher pressure into a vacuum chamber, measurements are typically taken over a wide range of pressures, and a primary gas species can change. For RGA, small quadrupole geometries (e.g., 6 mm or less) are typically used with a sightline of charged particle flow from the charged particle source to the quadrupole filter or lens. With a sightline of charged particle flow from the charged particle source to the quadrupole filter, a baseline signal of an output spectrum can change with changes of species and/or pressure. Thus, the baseline of the output spectrum may obscure the true output spectrum.

SUMMARY

To overcome these drawbacks, an ion flow-direction structure is proposed that advantageously utilizes cylindrical geometries between the ion source and the charged particle analyzer. The flow-direction structure includes a cylindrical body to which an electric charge can be applied for establishing an electric field within the cylindrical body. The cylindrical body defines a central axis therethrough. The flow-direction structure includes an entrance aperture at one end of the cylindrical body for receiving an incident beam of ions (e.g., from an ion source) and an exit aperture at the other end of the cylindrical body through which the ion beam exits the structure (e.g., to the charged particle analyzer). Both the entrance and exit apertures are displaced from the central axis of the cylindrical body. Stated differently, neither the entrance aperture (associated with the ion source) nor the exit aperture (associated with the charged particle analyzer) are coaxial with the central axis of the cylindrical body. In this way, a sightline between both the ion source and the charged particle analyzer that is parallel to the central axis is eliminated. In the vacuum environment of a charged particle analyzer (such as a mass spectrometer), positioning both apertures "off-axis" results in substantial reduction of baseline signal offsets (for example, in the mass spectrum). The reduction in baseline signal offsets may be attributed to prevention of neutral species (e.g., photons and/or metastable atoms or molecules) and/or energetic charged particles from passing from the charged particle or ion source to the charged particle analyzer and/or detector. Additionally, the use of a cylindrical geometry takes advantage of inherent properties of a cylindrically symmetric electric field and allows the flow-direction structure to operate at lower voltages, thereby improving safety and reducing risk of electric shock.

While described herein as applicable to beams of ionized particles, it will be apparent to those of skill that the concepts also apply to other types of charged particles. Additionally, while an illustrative embodiment described herein involves a cylindrical body, it will be apparent to those of skill that hollow bodies of differing geometry could also be used provided the entrance aperture and exit apertures are not aligned or coaxial with a central axis of such hollow bodies.

A mass spectrometer system that eliminates unwanted noise and/or unwanted background effects, operates in a multi-pressure, multi-species environment and minimizes a baseline offset of an output spectrum is desirable. An ion filter or lens that can inhibit a sightline of charged particle flow between a charged particle source and a charged particle analyzer is also desirable, while operating at relatively low voltages and with desirable tuning properties relative to the energy of incident ions is also desirable. The cylindrical geometry can be used to focus ions exiting the flow-direction structure efficiently on the detector or analyzer, resulting in a more robust mass spectrum. A mass spectrometer system that can prevent a sightline of ion flow between an entrance and an exit of a charged particle flow region is also desirable.

The techniques described herein provide for the prevention of neutral particles, photons, charged particles whose energy differs (e.g., is higher or lower) than the particles to be analyzed, and unwanted protons from passing from a charged particle source (e.g., ion source) to a charged particle analyzer or a detector. In addition, the techniques also allow for the reduction of baseline artifacts and electron-stimulated desorption peaks in measurements and mass spectra.

Baseline offset is reduced when a sightline between an ion source and a charged particle analyzer is obscured. One way to achieve an obscured sightline is to position the ion source and the charged particle analyzer off-axis relative to a flow region. A variety of ways are disclosed to position the source and charged particle analyzer off-axis while still achieving a sufficient signal for generating a robust mass spectrum. A flow-direction assembly prevents/inhibits a sightline from the source to the charged particle analyzer where composition and/or pressure in the ion source is allowed to vary, which results in a realization of baseline offset reduction.

In one aspect, there is a charged particle lens assembly. The charged particle assembly includes a hollow body defining a first end, a second end and a first axis extending from the first end to the second end along a centerline of the hollow body. The charged particle lens also includes a first electrode assembly positioned relative to the first end of the hollow body and defining a first aperture spaced from the first axis for receiving an incident beam of charged particles. The charged particle assembly also includes a second electrode assembly positioned relative to the second end of the hollow body and defining a second aperture spaced from the first axis for passing charged particles out of the lens assembly. The hollow body is configured to, when an electric potential is applied, direct a supply of charged particles incident from the first aperture towards the second aperture for exiting the assembly.

Some implementations include the first aperture being spaced from the first axis a distance substantially equal to a distance the second aperture is spaced from the first axis (e.g., the first and second apertures are equidistant from the first axis). In some embodiments, the first aperture and the second aperture are positioned opposite with respect to the first axis (e.g., such that the distance between the first and second aperture is twice the distance of either aperture from the first axis). The hollow body can have a circular cross section in a plane orthogonal to the first axis. In some embodiments, the hollow body is cylindrically-shaped. The hollow body can define a geometry that has mirror symmetry in a first plane perpendicular to the first axis and in a second plane that is substantially orthogonal to the first plane.

In some embodiments, the first electrode assembly comprises a first electrode that defines a second axis that is substantially parallel to the first axis and substantially centered on the first aperture. The second electrode assembly can include a second electrode that defines a third axis substantially parallel to the first axis and substantially centered on the second aperture. A charged particle beam incident upon the first electrode travels through the first electrode along at least a portion of the second axis, and then travels through the hollow body across a portion of the first axis and through the second electrode along at least a portion of the third axis.

Some embodiments feature the first and second electrodes including grounded screens. The first and second electrodes can include shield grids or aperture plates. In some embodiments, the first electrode includes a circular aperture that is concentric with the second axis, and the second electrode includes a circular aperture concentric with the third axis.

In some embodiments, the charged particle lens assembly includes a means for applying the electric potential (e.g., to the hollow body and/or the electrode assemblies). Some embodiments feature the means for applying the electric potential being a power supply or an electrically-conductive material. In some embodiments, the electrical potential applied is substantially equal to an average energy of the supply of charged particles or ions. In some implementations, the hollow body has a length between approximately 1.3 and 1.6 times a diameter of the first end, the second end, or both. Such a configuration provides advantageous focusing due, in part, to the geometry of the hollow body and the energy of the incident ion beam.

Another aspect features a charged particle lens assembly that includes a central region. The central region includes a first hollow body that defines a first exterior end, a first interior end and a first axis extending from the first exterior end to the first interior end along a centerline. The central region also includes a second hollow body that defines a second interior end positioned relative to the first interior end, a second exterior end and a second axis extending from the second interior end to the second exterior end. The second axis is aligned with the first axis. The central region also includes an interior aperture between the first interior end of the first hollow body and the second interior end of the second hollow body. The interior aperture is spaced from the first axis and the second axis. The charged particle lens assembly also includes a first electrode assembly positioned relative to the first exterior end of the first hollow body. The first hollow body defines a first aperture spaced from the first axis for receiving an incident beam of charged particles. The charged particle lens assembly also includes a second electrode assembly positioned relative to the second exterior end of the second hollow body and defining a second aperture spaced from the second axis for passing charged particles out of the lens assembly. The central region is configured to, when a first electric potential is applied to the first hollow body and a second electric potential is applied to the second hollow body, direct a supply of charged particles incident from the first aperture through the first hollow body towards the interior aperture and from the interior aperture towards the second aperture for exiting the assembly. In some implementations, the charged particle lens assembly is referred to as a two-stage deflector or flow-direction structure.

Some implementations include the first aperture of the first hollow body being spaced from the first axis a distance substantially equal to the distance the second aperture is spaced from the first axis. Some implementations include the internal aperture being on an opposite side of the axis from the first aperture and the second aperture.

In some embodiments, the first electrode assembly includes a first electrode defining a third axis substantially parallel to the first axis and substantially centered on the first aperture, and the second electrode assembly comprises a second electrode defining a fourth axis substantially parallel to the first axis and substantially centered on the second aperture and substantially coaxial with the third axis.

In some embodiments, the first and second electrodes include grounded screens. The first and second electrode assemblies can include shield grids or aperture plates. In some embodiments, the first electrode includes a cylindrical shape circular aperture concentric with the third axis and the second electrode includes a circular aperture concentric with the fourth axis. In some embodiments, the first and second electrodes include shield grids or aperture plates.

Another aspect relates to a system that includes an interface to a supply of charged particles having a variable pressure or gas composition. The system includes a particle flow-direction structure in communication with the supply of charged particles. The charged particle flow-direction structure includes (a) a hollow body defining a first end and a second end and a first axis extending from the first end to the second end along a centerline of the hollow body; (b) a first electrode assembly positioned relative to the first end of the hollow body and a first aperture spaced from the first axis for receiving an incident supply of charged particles; and (c) a second electrode assembly positioned relative to the second end of the hollow body and a second aperture spaced from the first axis. The hollow body is configured to, when an electric potential is applied, direct a supply of charged particles incident from the first electrode assembly towards the second electrode assembly. The system also includes a charged particle analyzer module in communication with the particle flow-direction structure and positioned relative to the second electrode assembly to receive a flow of charged particles exiting the particle flow-direction structure.

Some embodiments feature the charged particle analyzer module being in fluid communication with, electrical communication with, or both fluid and electrical communication with the particle flow-direction structure. In some embodiments, the charged particle analyzer module includes at least a portion of the second electrode assembly.

Yet another aspect features a system including means for interfacing to a supply of charged particles having a variable pressure or gas composition. The system also includes a particle flow-direction means for directing a flow of particles received from the means for interfacing at a first electrode assembly via a first aperture along a flow path through a hollow body toward a second electrode assembly adjacent a second aperture. The first aperture and second aperture are spaced from an axis extending from a first end to a second end of the hollow body along a centerline of the hollow body. The flow path is defined at least in part by an electric potential applied to the hollow body. The system also includes a charged particle analyzer means in communication with the particle flow-direction means for collecting and analyzing a flow of charged particles from the particle flow-direction means.

Another aspect involves a method of changing a baseline offset of a charged particle analyzer. The method involves varying at least one of a pressure or a gas composition within a charged particle source. The method also involves receiving a flow of particles from the charged particle source into a flow region defining a first end and a second end, at a first site of the first end of the flow region. The method also involves directing the received flow of particles from the first site along a flow path towards a second site of the second end of the flow region. The first site and the second site are spaced from an axis extending from the first end to the second end of the flow region. The second site is positioned such that a sightline from the first end to the second end parallel to a direction of the flow of particles at the first site does not intersect the second site. The method also involves generating a spectrum based on collected charged particles.

In some embodiments, the source of charged particles is not visible along the sightline at a position coincident with an entrance aperture of a charged particle analyzer and through the flow region. In some embodiments, the axis extending from the first end to the second end of the flow region is substantially parallel to the sightline, and the flow path crosses the axis. Some embodiments feature the second end being positioned relative to the first end such that the axis extends along a 90-degree arc. In some implementations, the second end of the flow region is positioned relative to the first end such that the axis extends along an arc between 0 and 180 degrees.

Some implementations involve supplying an electric potential to a hollow body having a first axis along a centerline of the hollow body. The electric potential provides an electric field that directs charged particles incident on the first site through the body across the centerline to the second site.

Some embodiments involve positioning a first electrode assembly relative to the first end of the hollow body and a second electrode assembly relative to the second end of the hollow body. The first electrode assembly defines a first aperture spaced from the first axis for receiving an incident beam of charged particles, and the second electrode assembly defines a second aperture spaced from the first axis for passing charged particles out of the lens assembly. The hollow body is configured to, when an electric potential is applied, direct a supply of charged particles incident from the first aperture towards the second aperture for exiting the assembly.

Some implementations involve applying a first voltage to the hollow body and applying a second voltage to the first electrode assembly, the second electrode assembly, or both. The method can involve selectively directing charged particles out of the flow region based on charged particle energy. In some embodiments, directing the flow particles through the flow region includes obstructing a flow of neutral species of the particles towards the second site of the flow region.

Yet another aspect relates to a method of inhibiting a sightline between a charged particle source and an input to a charged particle analyzer or detector. The method involves applying a predetermined voltage to a hollow body defining a first end, a second end and a first axis extending from the first end to the second end along a centerline of the hollow body. The predetermined voltage establishes an electric field within the body for directing a flow of charged particles through the hollow body along a desired flow path from an incident aperture spaced from the first axis to an exit aperture spaced from and reflected about the first axis. The method also involves applying a first electrode voltage to a first electrode assembly disposed relative to the first end of the hollow body and applying a second electrode voltage to a second electrode assembly disposed relative to the second end of the hollow body.

Some implementations involve separating the charged particle source from the charged particle analyzer by one or more differentially-pumped regions. In some embodiments, the method involves disposing the charged particle source and the charged particle analyzer within a vacuum environment. Near-vacuum or low-pressure environments might also be suitable.

Some embodiments feature adjusting the first electrode voltage and the second electrode voltage to optimize the transmission of charged particles through the system. In some embodiments, the predetermined voltage applied to the hollow body is substantially equal to an average energy of the flow of charged particles.

In some implementations, any of the above aspects can include any (or all) of the above-recited features.

These and other features will be more fully understood by reference to the following description and drawings, which are illustrative and not necessarily to scale.

DETAILED DESCRIPTION

Described herein is an ion flow-direction or lens structure that advantageously utilizes cylindrical or other symmetrical geometries between the ion source and the charged particle analyzer. The lens structure includes a cylindrical body that defines a central axis therethrough. An electric charge can be applied to the cylindrical body for establishing an electric field within the cylindrical body. The lens structure includes an entrance aperture at one end of the cylindrical body for receiving an incident beam of ions (e.g., from an ion source) and an exit aperture at the other end of the cylindrical body through which the ion beam exits the structure (e.g., to the charged particle analyzer). Both the entrance and exit apertures are displaced from the central axis of the cylindrical body. Stated differently, neither the entrance aperture (associated with the ion source) nor the exit aperture (associated with the charged particle analyzer) are coaxial with the central axis of the cylindrical body. In this way, a sightline between both the ion source and the charged particle analyzer that is parallel to the central axis is eliminated. In vacuum environments, positioning both apertures "off-axis" results in substantial reduction of unwanted photons, neutral species, and energetic ions passing from the charged particle or ion source to the analyzer and/or detector with attendant reduction in baseline signal offsets in the resulting spectrum. Additionally, the use of a cylindrical geometry takes advantage of inherent properties of a cylindrically symmetric electric field and allows the lens structure to operate at lower voltages than some known systems, for example, those of U.S. Pat. Nos. 4,481,415 or 5,495,107, thereby improving safety and reducing risk of electric shock. The lens structure here is relatively small in size and suitable for use with vacuum-based or low-pressure ion sources.

Figure 1:
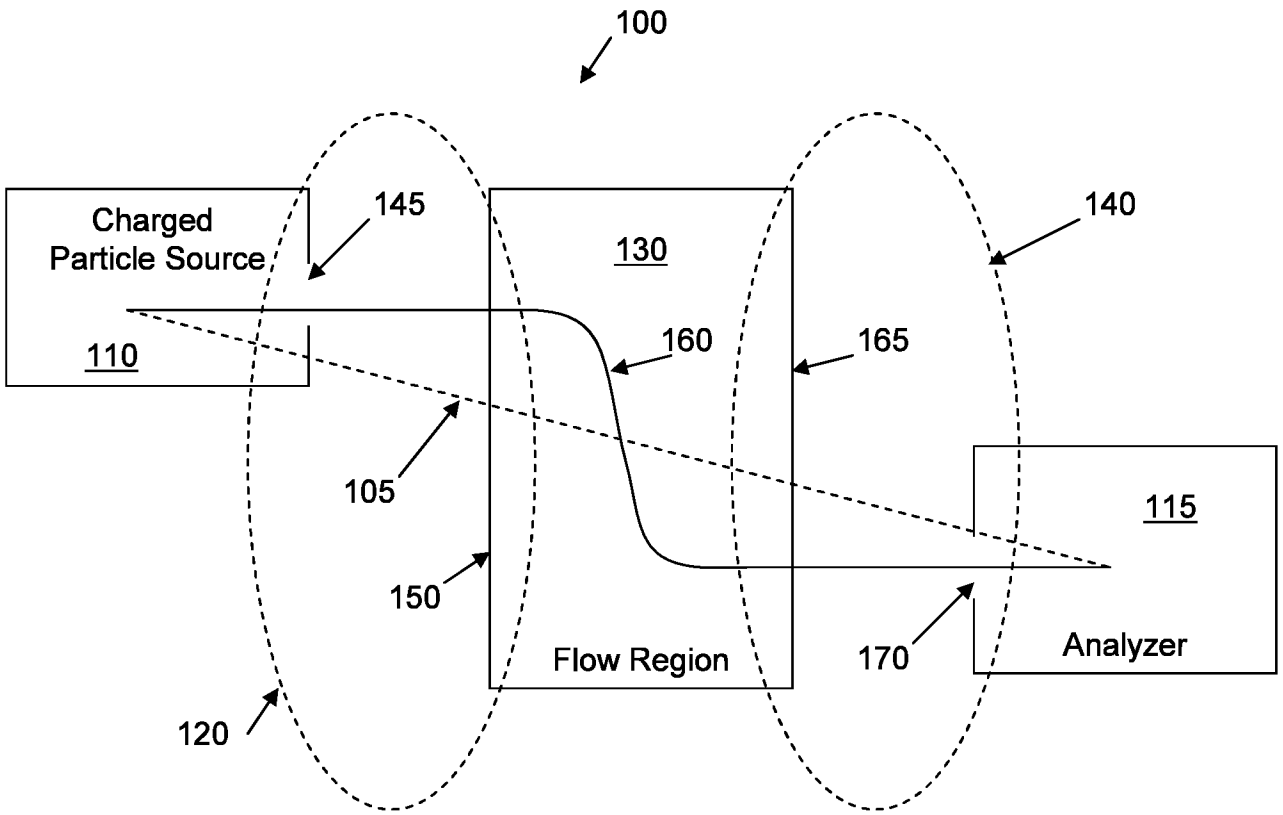
FIG. 1 is an exemplary block diagram of a system for inhibiting a sightline between a charged particle source and an analyzer.

FIG. 1 is an exemplary block diagram of a system 100 for inhibiting a sightline 105 between a charged particle source 110 and an analyzer 115. In addition to the charged particle source 110 and the analyzer, 115, the system 100 includes a first electrode assembly 120, a flow region 130, and a second electrode assembly 140. The first electrode assembly 120 is shown, conceptually, as positioned between the charged particle source 110 and the flow region 130. The second electrode assembly 140 is shown, conceptually, as positioned between the flow region 130 and the analyzer 115.

In some embodiments, the first electrode assembly 120 includes an aperture plate, grid electrode, and/or grounded screen. The charged particle source 110 can comprise a portion of the first electrode assembly 120. For example, an exit plate electrode (not shown) of the charged particle source 110 that directs charged particles out of the charged particle source 110 could be considered a part of the first electrode assembly 120 for cooperatively directing the charged particles towards the flow region 130. In some embodiments, the second electrode assembly 140 includes an aperture plate, grid electrode, or grounded screen. The analyzer 115 can comprise a portion of the second electrode assembly 140. For example, an entrance plate electrode of the analyzer 115 that directs charged particles towards the analyzer 115 could be considered a part of the second electrode assembly 140.

The charged particle source 110 provides or emits a flow of charged particles from an exit aperture 145 into a first end 150 of the flow region 130 via the first electrode assembly 120. The charged particles are directed along a flow path 160 through the flow region 130 to a second end 165 of the flow region 130. The charged particles exit the flow region 130 via the second electrode assembly 140. The charged particles enter the analyzer 115 via an entrance aperture 170. As shown in FIG. 1, the charged particles flow from the charged particle source 110 to the analyzer 115 along a flow path 160, despite the sightline 105 between the charged particle source 110 and the analyzer 115 being obscured. Additionally, a sightline (not shown) between the exit aperture 145 of the source 100 and the entrance aperture 170 of the analyzer 115 can be obscured by, e.g., the flow region 130 and the first end 150 and second end 165 of the flow region. In some embodiments, the flow of charged particles is in the form of an ion beam, and the flow path 160 depicts a characteristic or ideal path for the ion beam, e.g., focused or collimated as it exits the source 110, deflected through the flow region 130 and focused or collimated as it enters the analyzer 115.

The flow, pressure or composition within the charged particle source 110 can vary during supply of charged particles. For example, the charged particle source 110 can emit argon ions with a species having an average energy of 10 eV positive ions when the pressures within the source 110 can vary from, for example, 1 Pa to 0.0001 Pa. In some embodiments, the average energy of the positive ions is related to the type or species of the ions. In some embodiments, the flow of charged particles being measured has average energies that vary from about 5 eV to about 10 eV. In some embodiments, the analyzer 115 communicates with a computer, computer memory and/or display.

Figure 2A:
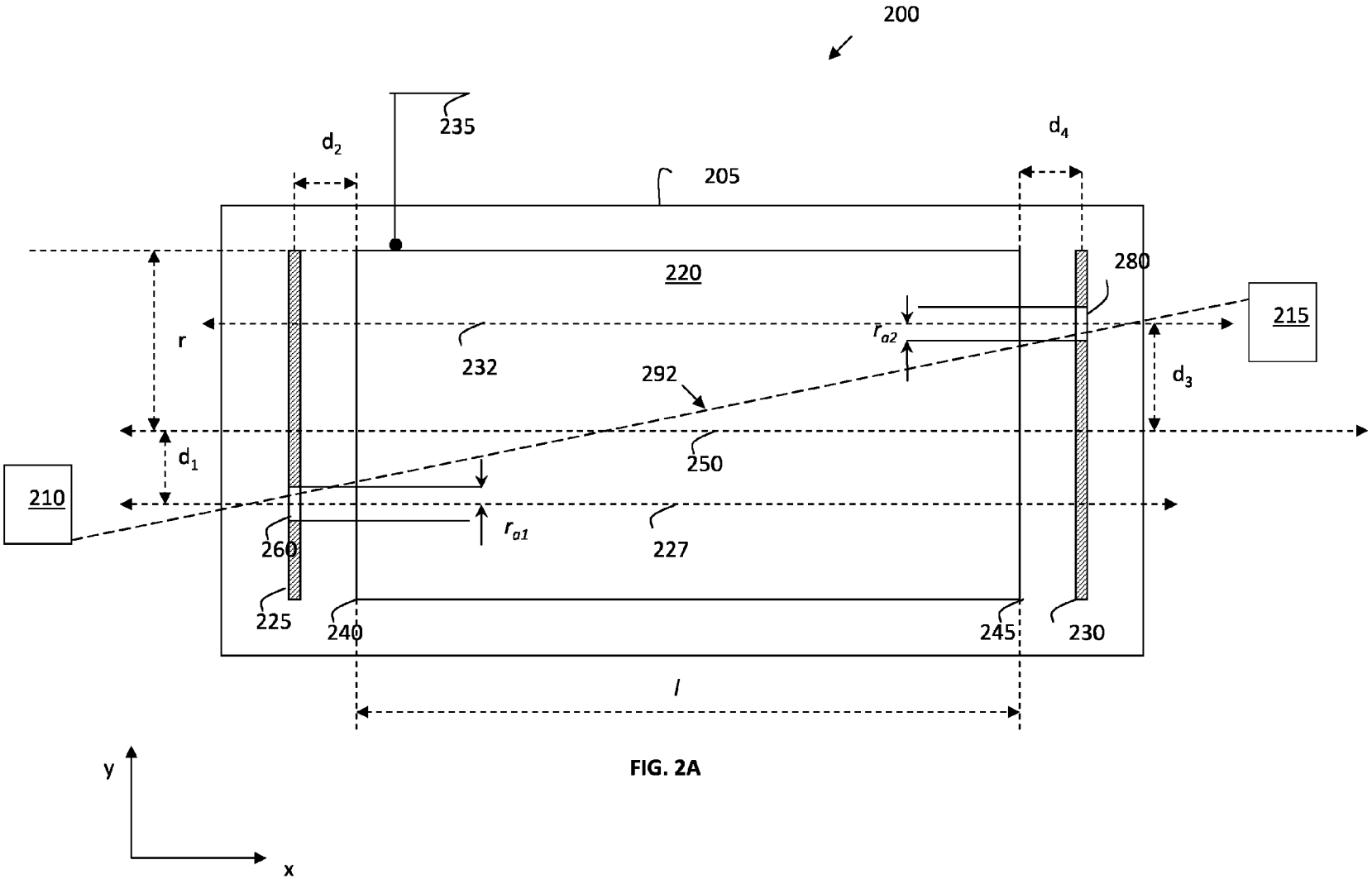
FIG. 2A is an exemplary block diagram of a charged particle lens assembly for inhibiting a sightline between a source and an analyzer.

FIG. 2A is an exemplary block diagram 200 of a charged particle lens assembly 205 for inhibiting a sightline between a charged particle source 210 and an exit region 215 that is parallel to a central axis 250 of a hollow body 220 of the assembly 205. The charged particle source 210 can emit or provide a supply of charged particles to the charged particle lens assembly 205. The supply of charged particles can be an ion beam, an ion spray, an ion cloud, a beam of electrons, or combinations of these. The charged particle lens assembly 205 includes the hollow body 220, a first electrode assembly 225 and a second electrode assembly 230.

The hollow body 220 includes an electric potential input 235, a first end 240, a second end 245 and axis 250. The axis 250 extends from the first end 240 to the second end 245 along a centerline of the hollow body 220. As depicted, the axis 250 travels along a 0-degree arc or path. The axis 250 can extend from the first end 240 to the second end 245 along arcs between 0 and 180 degrees, as discussed further with respect to FIGS. 3A-3C.

In some embodiments, the hollow body 220 has a circular cross section in a plane (not shown) orthogonal to the axis 250. This would be true in embodiments in which the hollow body is spherical, conical, or cylindrical. In some embodiments, the hollow body 220 is cylindrical, which results in a flow path through the hollow body 220 having advantageous features. In some embodiments, the hollow body 220 is a cylindrical lens with a radius (r) and a length (l). In some embodiments, the length (l) of the hollow body 220 is between approximately 1.3 and 1.6 times the size of a diameter (2r) of the first end 240, the second end 245, or both. A hollow body 220 with aspect ratios in this range exhibits desirable operating parameters, such as low-voltage operation for tuning and focusing an ion beam within the hollow body 220. In some embodiments, the cylindrical lens has pure cylindrical symmetry, which advantageously deflects and focuses the ion beam, without the need for additional, transverse field-generating elements to deflect the ion beam within the assembly 205. In some embodiments, the hollow body 220 has mirror symmetry in a first plane (not shown) that is perpendicular to the axis 250 and in a second plane (not shown) that is substantially orthogonal to the first plane. A hollow body 220 with these mirror symmetries advantageously focuses and deflects the ion beam within the hollow body 220, again, without the need for transverse field-generating elements to supply an electric field to influence the deflection.

The configuration of FIG. 2A allows for positioning of components to take advantage of both physical and electric field symmetries, resulting in potentially improved or easier tuning of the lens system.

The first electrode assembly 225 includes a first aperture 260. The first electrode assembly 225 defines an axis 227 that is substantially parallel to the axis 250 and substantially centered on the first aperture 260. The first aperture 260 is displaced a distance d1 from the axis 250 along the y-axis. The first electrode assembly 225 is displaced at a distance d2 along the x-axis from the first end 240 of the hollow body 220.

The second electrode assembly 230 includes a second aperture 280. The second electrode assembly 230 defines an axis 232 that is parallel to the axis 250 and substantially centered on the second aperture 280. The second aperture 280 is displaced a distance d3 from the axis 250 along the y-axis. The second electrode assembly 230 is displaced at a distance d4 along the x axis from the second end 245 of the hollow body 220.

In various embodiments, the first electrode assembly 225 includes a first electrode. For example, the first electrode can be a grounded screen, shield grid or aperture plate. As illustrated in FIG. 2A, the first electrode assembly 225 includes an aperture plate as an electrode. FIG. 2E illustrates an embodiment in which the first electrode assembly 225 includes a grid electrode. The first aperture 260 can be included in the first electrode assembly 225. The first aperture 260 can have a circular profile that is concentric with the second axis 227. The first circular shaped aperture 260 can be displaced from the axis 250 by the radius $r_{a1}$ of the first circular shaped aperture 260. In other words, in some embodiments, the distance d1 is substantially equal to the distance $r_{a1}$. In some embodiments, the second electrode assembly 230 includes a second electrode. The second electrode can be a grounded screen, shield grid or aperture plate. As illustrated in FIG. 2A, the second electrode assembly 230 includes an aperture plate as an electrode. FIG. 2E illustrates an embodiment in which the second electrode assembly 230 includes a grid electrode. The second aperture 280 can be included in the second electrode assembly 230. The second aperture 280 can have a circular profile that is concentric with the third axis 232. The second circular shaped aperture 280 can be displaced from the axis 250 by the radius $r_{a2}$ of the second circular shaped aperture 280. In other words, the distance d3 is, in some embodiments, substantially equal to the distance $r_{a2}$. Additionally, the size of the aperture 260 $r_{a1}$ can be the same size of the aperture 280 $r_{a2}$.

In some embodiments, the first aperture 260 and the second aperture 280 are positioned at a substantially equal distance from the axis 250 (e.g., the distance d1 substantially equals the distance d3). In some embodiments, the first aperture 260 and the second aperture 280 are positioned oppositely with respect to the axis 250 (e.g., mirror images about the axis 250 in the x-y plane). In some embodiments, the first electrode assembly 225 is spaced from the first end 240 at a distance d2 that is less than the diameter (2r) of the hollow body 220. In some embodiments, the second electrode assembly 230 is spaced from the second end 245 at a distance d4 that is less than a diameter (2r) of the hollow body 220. In some embodiments, the first electrode assembly 225 is spaced from the first end 240 a substantially equal distance to the distance the second electrode assembly 230 is spaced from the second end 245 (e.g., the distance d2 substantially equals the distance d4). In exemplary embodiments, the distance r can be about 8 mm, the distances d1 and d3 can be about 3 mm, and the distances d2 and d4 can be about 1 mm.

In operation, the charged particle lens assembly 205 receives a supply of charged particles (not shown) at the first aperture 260 of the first electrode assembly 225. The supply of charged particles is received from charged particle source 210 or from an intermediate structure that focuses, collimates or conditions the charged particles or beam. The electric potential input 235 applied to the hollow body 220 establishes an electric field (not shown) within the hollow body 220 that can drive or direct the supply of charged particles to the second aperture 280 of the second electrode assembly 230. The second electrode assembly 230 passes the supply of charged particles out of the charged particle lens assembly 205. The electric field is tuned or focused such that the beam enters along a direction substantially parallel to the axis 227 and exit along a direction substantially parallel to the axis 232, which involves the beam crossing the axis 250. By selective application of electric fields, the ion beam can be directed from the entrance aperture 260 to the exit aperture 280 through the hollow body 220 along a desired flow path (e.g., having the general geometry of the flow path 160 of FIG. 1). In this way, the source 210 and the exit region 215 can each be positioned at a distance from the axis 250, thereby obscuring a sightline between the source 210 and the exit region 215 while permitting ion flow from the source 210 to the exit region 215.

In some embodiments, the electric potential input 235 drives or directs the supply of charged particles through the first electrode assembly 225 along a portion of the second axis 227, through the hollow body 220 across a portion of the axis 250 and through the second electrode assembly 230 along a portion of the third axis 232. In some embodiments, the first electrode assembly 225 and/or the second electrode assembly 230 include electrical potential inputs (not shown). In some embodiments, the first electrode assembly 225 and/or the second electrode assembly 230 are in communication with a supply of electrical energy. The electrical potential applied to the first electrode assembly 225, the second electrode assembly 230, and/or the hollow body 220 can be a direct current (or, in some implementations, an alternating current). In some embodiments, the exit region 215 communicates with an analyzer, a computer, computer memory and/or display.

Upon exiting the second aperture 280, the charged particles are received in exit region 215. Exit region 215 can be an analyzer (e.g., mass analyzer) or detector, a second hollow body or some other structure for processing, directing communication or conditioning charged particles. For example, the exit region 215 can be a second stage of a two-stage deflector lens, in which case, the aperture 280 would be an interior aperture between the first stage (depicted in FIG. 2A) and the second stage (not shown).

While a straight line 292 can be drawn between the source 210 and the exit region 215, the line 292 does not represent a realistic flight path for the beam of ions, which are subject to curved electric field gradients within the assembly 205. Moreover, a sightline (not shown) parallel to the axis 227 and within the aperture 260 does not intersect or reach the exit region 215. Similarly, a sightline (not shown) parallel to the axis 232 and within the aperture 280 does not reach or intersect the source. The radii $r_{a1}$ and $r_{a2}$ (of apertures 260, 280) can be larger than implied in the schematic of FIG. 2A. Practical aspects of directing ion flow tend to further inhibit any direct sightline between the source 210 and the exit region 215, and so the assembly 205 can be readily designed such that a sightline through either aperture 260 or 280 and parallel to the axis 250 does not intersect the exit region 215 or the source 210, respectively. For example, provided $r_{a1}$ and $r_{a2}$ are less than approximately the distances d1 and d3, respectively, a sightline parallel to axis 250 and within the aperture 260 or 280 will not intersect the exit region 215 or source 210, respectively.

Figures 2B, 2C:
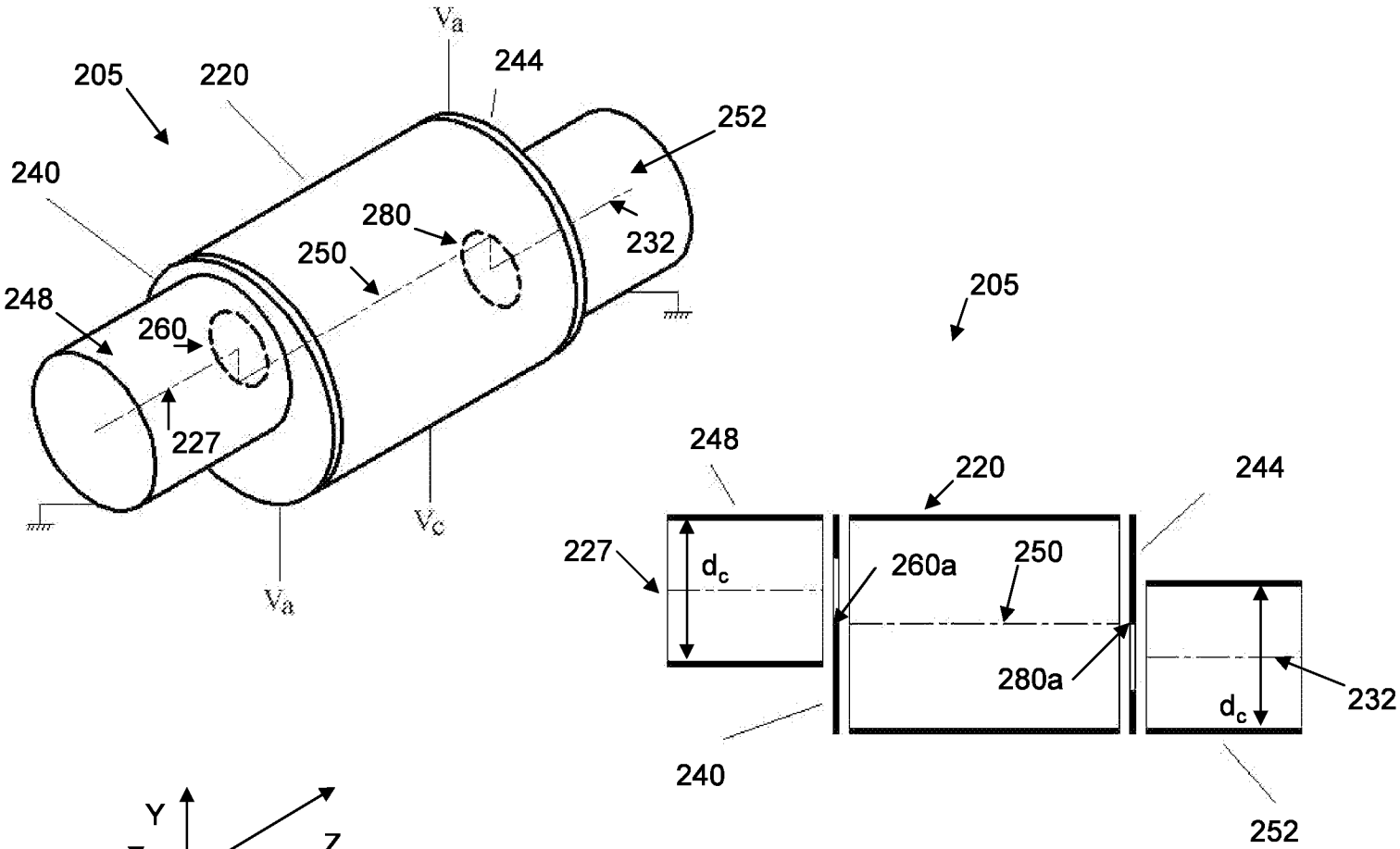
FIG. 2B is an isometric view of a charged particle lens assembly.
FIG. 2C is a cross-sectional view of the charged particle lens assembly of FIG. 2B.

FIG. 2B is an isometric view of a charged particle lens assembly 205. The assembly 205 includes the hollow body 220 and central axis 250. The assembly 205 includes an aperture plate 240 that defines an aperture 260 and a second aperture plate 244 that defines an aperture 280. The assembly 205 includes a cylindrical structure 248 that defines an axis 227 that is concentric with the aperture 260 and a second cylindrical structure 252 that defines an axis 232 concentric with the aperture 280. As illustrated, the cylindrical structure 248 is centered about the aperture 260 and the cylindrical structure 252 is centered about the aperture 280, but this is not required.

The cylindrical structure 248 can be positioned adjacent to a source of ions or charged particles (e.g., source 210) and used to, for example, focus and direct the ion beam towards or on the aperture 260 in the aperture plate 240. The cylindrical structure 248 can be referred to as the "incident-side" or "source-side" structure and is, in some embodiments, a grounded screen. The cylindrical structure 252 can be positioned adjacent to an exit region (e.g., the exit region 215), a detector (not shown) or analyzer (not shown) and used to, for example, focus and direct the ion beam towards or on an aperture (not shown) of the detector or analyzer. The cylindrical structure 252 can be referred to as the "exit-side" or "detector/analyzer-side" structure and is, in some embodiments, a grounded screen. The electric field within the hollow body 220 focuses and directs the beam of ions towards the aperture 280 in the aperture plate 244 for transmission to the cylindrical structure 252.

A voltage or electric potential, Vc, is applied to the hollow body 220 and a second voltage or electric potential, Va, is applied to the aperture plate 240, the aperture plate 244, or both. In some implementations, the value of the electric potential Va applied to aperture plate 240 differs from the value of the electric potential Va applied to aperture plate 244.

FIG. 2C is a cross-sectional view of the charged particle lens assembly 205 of FIG. 2B. The view of FIG. 2C illustrates a diameter $d_c$ of each of the cylindrical structures 248, 252 that is greater than the size of the apertures 260, 280 in the y-direction. The central axis 250 of the hollow body 220 clips an edge 260*a* of the aperture 260 and an edge 280*a* of the aperture 280 and extends into the source-side cylindrical structure 248 and the detector-side cylindrical structure 252. When the incident ion beam is aligned with the axis 227, the central axis 250 does not intersect the ion beam within the incident-side cylindrical structure 248 (and the detector-side cylindrical structure 252 is obscured from the axis 227, the ion beam, and the source (not shown)). Similarly, when the exiting ion beam is aligned with the axis 232, the central axis 250 does not intersect the ion beam within the exit-side cylindrical structure 252 (and the incident-side cylindrical structure 248 is obscured from the axis 232, the ion beam, and the exit region or charged particle analyzer (not shown)).

Figure 2D:
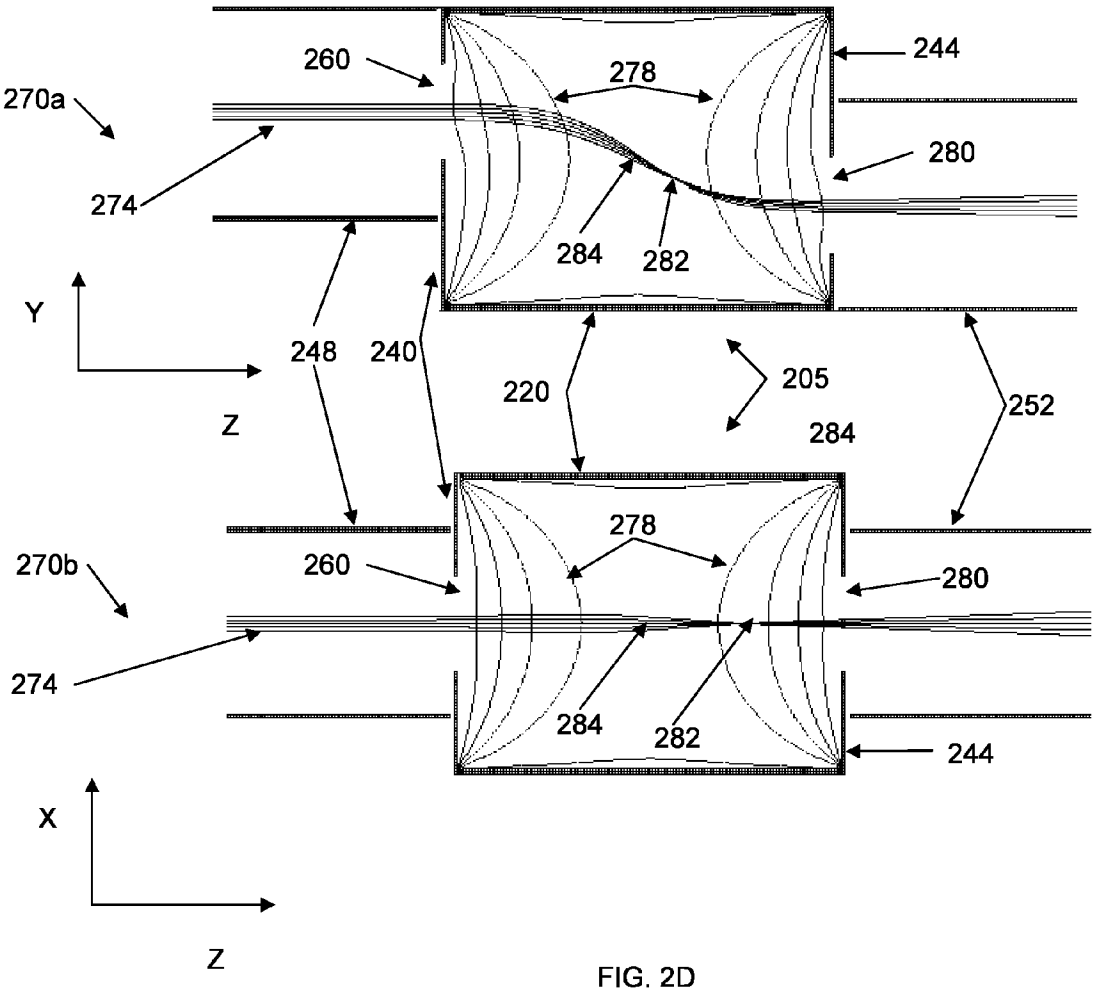
FIG. 2D is a schematic diagram of exemplary charged particle flow through the charged particle lens assembly of FIG. 2B, illustrated in two cross-sectional views.
Figure 2E:
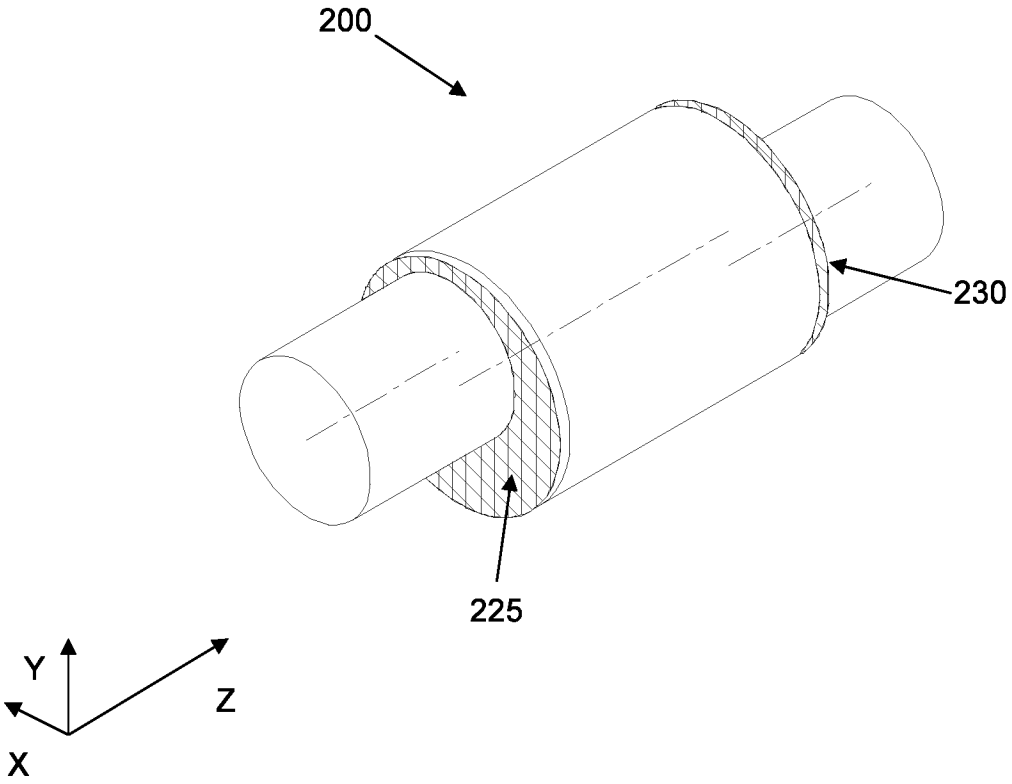
FIG. 2E is an isometric view of a charged particle lens assembly that includes shield grids as part of the electrode assemblies.

FIG. 2D is a schematic diagram of exemplary charged particle flow through the charged particle lens assembly 205 of FIG. 2B, illustrated in two views 270*a*-270*b*, based on a computer simulation. The view 270*a* depicts the flow of an ion beam 274 through the assembly 205 as it would appear in the y-z plane of FIG. 2B. The view 270*b* depicts the flow of the ion beam 274 through the assembly 205 as it would appear projected on the x-z plane of FIG. 2B. The view 270*b* also depicts the electrode structure and exemplary voltage contours. The view 270*b* represents a composite cross-section, constructed from three cross-sections parallel to the x-z plane along the axes 227, 250, and 232, respectively. Both views 270*a*-270*b* depict electric field lines 278 within the hollow body 220 when an electric potential is applied. The electric field lines 278 reflect the electric potential of the aperture plates 240, 244 as well. FIG. 2D depicts exemplary field lines and flow of the ion beam 274 when the electric potential applied to the hollow body 220 is 10V and the electric potential of the aperture plates 240, 244 is 0V. The average energy of the ion beam 274 in the simulation used to create FIG. 2D is 10 eV.

The beam 274 is focused in both the y-z and x-z planes, but in both planes the focal point 282 extends beyond a midpoint 284 of the hollow body 220. The focal point 282 can be shifted along the z axis by adjusting the electric potential applied to the electrodes 240 and 280, for example to make the emerging beam less divergent.

As can be seen in the view 270*a*, the cylindrical structures 248, 252 are offset and not centered relative to the hollow body 220 with respect to the y-axis, but the cylindrical structures 248, 252 are centered relative to the hollow body 220 with respect to the x-axis. FIG. 2D illustrates the deflection action imposed on the ion beam 274 as it traverses the assembly 205 and the hollow body 220.

Figure 3A:
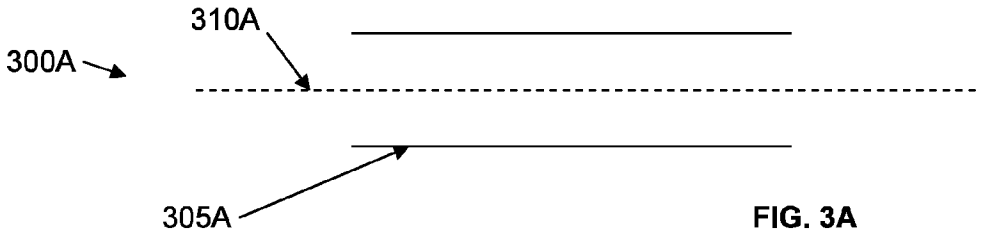
FIGS. 3A-3C are exemplary block diagrams of a charged particle lens assembly or flow regions in which a flow path travels along 0-degree, 90-degree and 180-degree arcs, respectively.
Figure 3B:
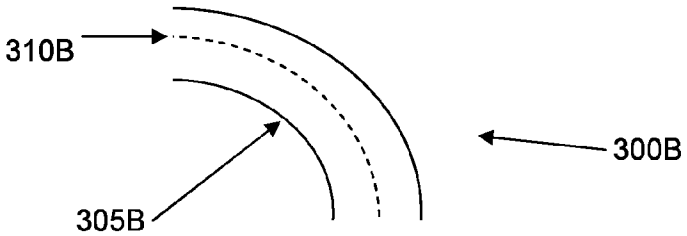
Figure 3C:
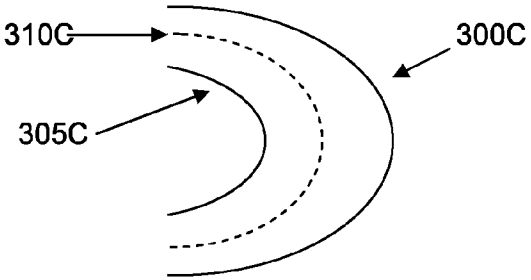

FIGS. 3A-3C are exemplary block diagrams 300A, 300B, 300C of a charged particle lens assembly 305A, 305B, 305C in which a flow path travels along 0-degree, 90-degree and 180-degree arcs 310A, 310B, 310C, respectively. Hollow body 305A of FIG. 3A includes or defines an axis 310A that extends along a 0-degree arc. Stated differently, the axis 310A provides a straight-line path through hollow body 305A. Hollow body 305B of FIG. 3B includes or defines an axis 310B that extends through a 90-degree arc. In other words, the axis 310B allows the ion source or the ion beam axis of exit from the ion source (not shown) to be oriented at a right angle to the detector or analyzer (or the ion beam axis of entry to the detector or analyzer) (not shown). Hollow body 305C of FIG. 3C includes an axis 310B that extends through a 180-degree arc. The axis 310C allows the ion source or the ion beam axis of exit from the ion source (not shown) to be parallel, but displaced from, the detector or analyzer (or the ion beam axis of entry to the detector or analyzer) (not shown).

Figure 4:
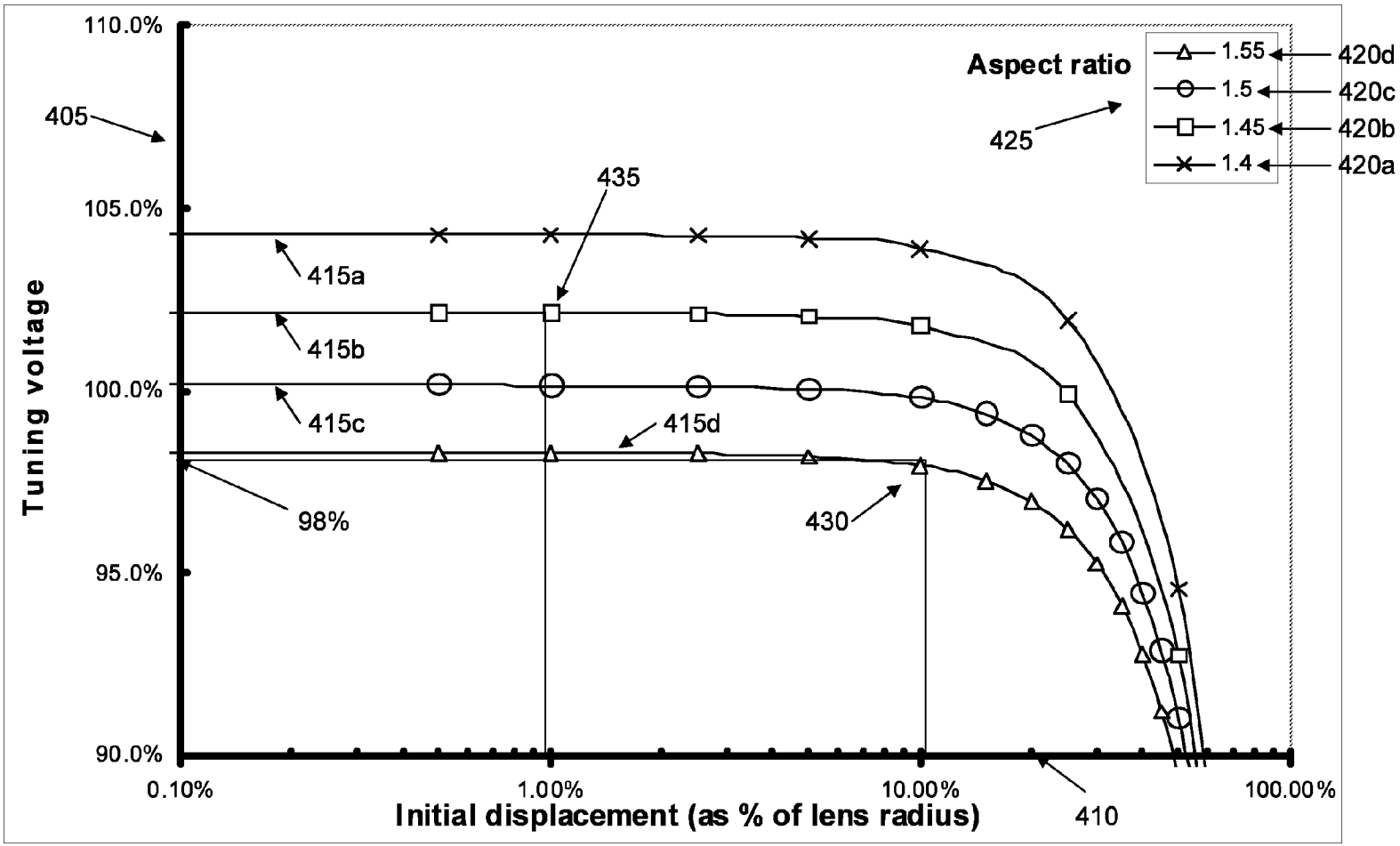
FIG. 4 is a graph plotting exemplary electrical potentials versus beam locations.

FIG. 4 is a graph 400 plotting exemplary tuning voltage versus beam location for a lens assembly using grid electrodes as shown in FIG. 2E. Tuning voltage values are plotted along the vertical axis 405, and beam location, as a percentage of hollow-body radius (e.g., radius r in FIG. 2A), is plotted along the horizontal axis 410. The graph 400 shows four electrical potential curves 415*a*-415*d*, representing the electric potential applied to four hollow bodies (e.g., cylindrical lenses), each having a different aspect ratio (e.g., length/diameter), for example, of the type illustrated in FIG. 2B. The values 420*a*-420*d* of the aspect ratio of the lens used to generate each curve 415*a*-415*d*, respectively, is shown in legend 425. The electrical potential along the vertical axis 410 (e.g., tuning voltage) is shown as a percentage of average energy of the species to be analyzed in the supply of charged particles. The values along the horizontal axis 410 of beam location represent displacement of a narrow beam of charged particles from a center of the cylindrical lens (e.g., hollow body 220) as a percentage of the radius of the cylindrical lens (e.g., radius r of hollow body 220). For example, the curve 415*d* shows that for a cylindrical lens with an aspect ratio of 1.55 (entry 420*d* in the legend 425), a beam of charged particles incident on the cylindrical lens at a distance from the center of the cylindrical lens that is 10% (represented as point 430 on the curve 415*d*) of the radius of the cylindrical lens, can be caused to travel along a flow path between an entrance aperture and an exit aperture of the cylindrical lens by an applied electric potential having approximately 98% of the energy of the supply of charged particles. In other words, an electric potential applied to the hollow body that is 98% of the average energy of the beam of ions will generate an electric field within the hollow body to optimize transmission from the entrance aperture to the exit aperture.

The curve 415*b* shows that for a cylindrical lens having an aspect ratio of 1.45 (entry 420*b* in the legend 425), a supply of charged particles incident on the cylindrical lens at a distance from the center of the cylindrical lens that is 1.0% (point 435 on the curve 415*b*) of the radius of the cylindrical lens, can be caused to travel along a flow path between an entrance aperture and an exit aperture of the cylindrical lens by an applied electric potential having approximately 102% of the average energy of the supply of charged particles.

Figure 5A:
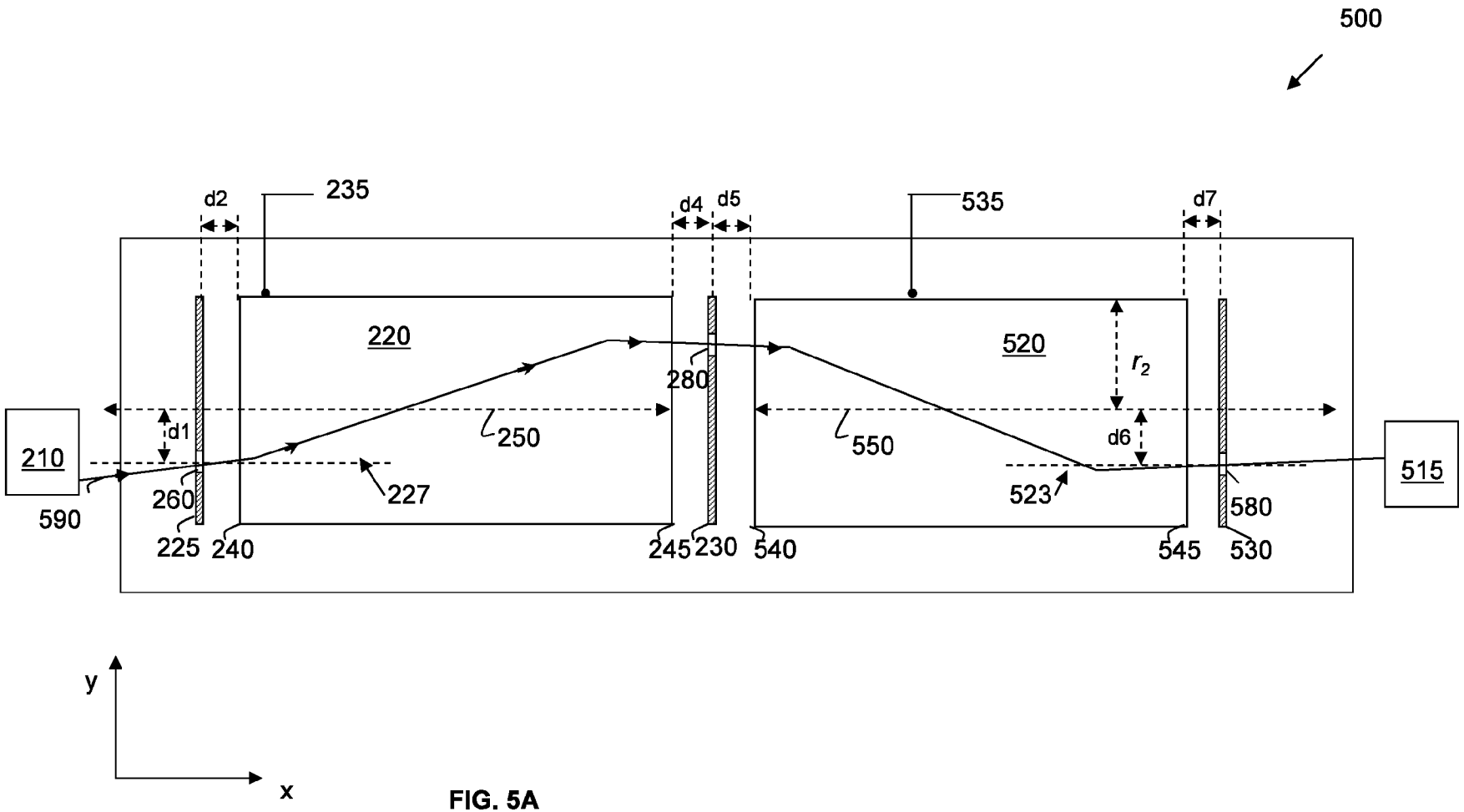
FIG. 5A is an exemplary block diagram of a charged particle lens assembly for inhibiting a sightline between a source and an analyzer.

FIG. 5A is an exemplary block diagram of a charged particle lens assembly 500 that includes a second hollow body 520 that, in cooperation with the hollow body 220, inhibits a sightline (not shown) between a charged particle source 210 and an exit region 515 that is parallel to the axis 250 of the hollow body 220 and/or the axis 550 of the hollow body 520. In FIG. 5A, the exit region 215 of FIG. 2 includes the second hollow body 520 and a third electrode assembly 530. In some implementations, the configuration of FIG. 5 is referred to as a two-stage deflector (e.g., a first stage refers, generally, to first hollow body 220 and second stage refers, generally, to second hollow body 520).

The charged particle lens assembly 500 includes the first hollow body 220, a second hollow body 520, the first electrode assembly 225, the second electrode assembly 230 and a third electrode assembly 530. The first hollow body 220, the first electrode assembly 225 and the second electrode assembly 230 are discussed, generally, above in FIG. 2. In the configuration of FIG. 5A, however, the second electrode assembly 230 is an intermediate electrode disposed between the first stage and second stage of the two-stage deflector assembly 500.

The hollow body 520 is displaced a distance d5 relative to the second electrode assembly 230 along the x-axis. The hollow body 520 includes an electric potential input 535, a first end 540, a second end 545 and a second axis 550. The second axis 550 extends from the first end 540 to the second end 545. The second axis 550 can be aligned with the axis 250 (e.g., along the x-axis) in the y-direction, but this is not required. The hollow body 520 can have approximately the same features and dimensions described above with respect to hollow body 220 of FIG. 2A.

The third electrode assembly 530 includes an aperture 580. The third electrode assembly 530 defines an axis 523 that is parallel to the second axis 550 and substantially centered on the aperture 580. The aperture 580 is displaced a distance d6 from the second axis 550 along the y-axis. The third electrode assembly 530 is displaced at a distance d7 from the second end 545 of the second hollow body 520. In some embodiments, the axis 523 is aligned with the axis 227 that is centered about the aperture 260. In some embodiments, the third electrode assembly 530 includes an electrical potential input (not shown).

In some embodiments, the distance d2, the distance d4, the distance d5 and the seventh distance d7 are equal. In some embodiments, the aperture 260 and the aperture 580 are positioned on the same side of the axis 250 (with respect to the y-axis) and the aperture 280 is positioned on an opposite side of the axis 250 than the aperture 260 and the aperture 580 (again with respect to the y-axis). In some embodiments, the third aperture 580 is spaced from the second end 545 at a distance d7 that is less than a diameter ($2r_2$) of the second hollow body 520.

The third electrode assembly 530 can include a third electrode. The third electrode can be a grounded screen, shield grid or aperture plate. The third electrode can include a cylindrical shaped aperture that is concentric with the axis 523 as shown, for example, in FIG. 5B.

In operation, the charged particle lens assembly 500 receives a supply of charged particles at the aperture 260 of the first electrode assembly 225. The electric potential applied to the hollow body 220, the hollow body 520, and the electrode assemblies 225, 230, and 530 cooperate to drive or direct the charged particles from the aperture 260, towards and through the aperture 280, towards and through the aperture 580 and towards the exit region 515. The line 590 through the assembly 500 depicts a conceptualized flow path from the source 210 to the exit region 515, but the actual shape of the flow path is generally smooth. While not depicted, the applied electric potentials generate electric fields whose properties are generally determined by the shape, geometry, and dimensions of the particular elements to which the electric potentials are applied. A grounded element represents an applied electric potential of 0 Volts. In some embodiments, the exit region 515 is a third hollow body, a charged particle analyzer, or some other structure for processing, directing communication or conditioning the beam of charged particles. One of skill will appreciate that any number of structures can be cascaded such that the supply of charged particles passes through any number of stages prior to collection, detection, and/or analysis.

In some embodiments, the electric potential 535 establishes an electric field that drives or directs (or cooperates in driving or directing) the supply of charged particles 590 through the hollow body 520 across a portion of the second axis 550 and through the third electrode assembly 530 along a portion of the axis 523, in cooperation with the electric fields elsewhere in the system 500.

Figure 5B:
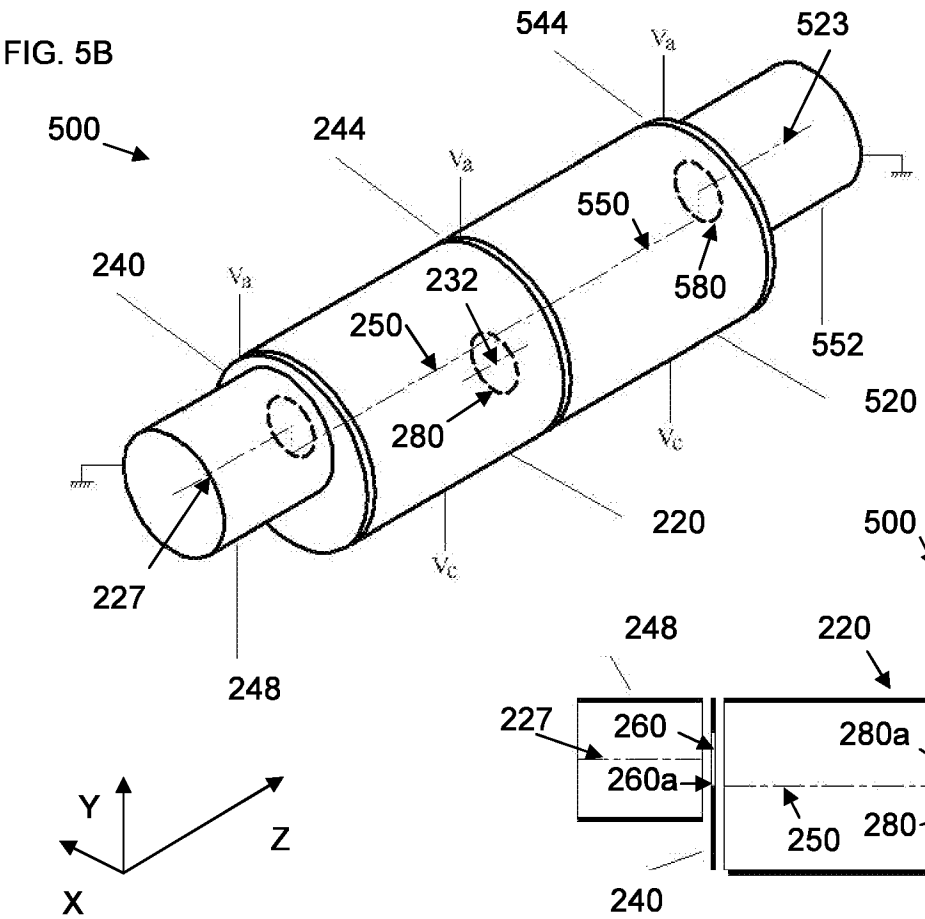
FIG. 5B is an isometric view of a two-stage charged particle lens assembly.

FIG. 5B is a perspective view of a two-stage charged particle lens assembly 500. The assembly 500 includes the hollow body 220, central axis 250, hollow body 520 and central axis 550. The assembly 500 includes an aperture plate 240 that defines an aperture 260, a second aperture plate 244 that defines aperture 280, and a third aperture plate 544 that defines aperture 580. A cylindrical structure 248 defines an axis 227 that is substantially concentric with the aperture 260. A second cylindrical structure 552 defines an axis 523 that is substantially concentric with the aperture 580. As with FIG. 2A, the cylindrical structure 248 is on the source-side and the cylindrical structure 252 is on the detector-side. The aperture 280 defines an axis 232 therethrough.

During operation, a supply of ions is received in the cylindrical structure 248 and passes through the aperture 260 generally aligned with the axis 227. The flow of ions travels through the hollow body and crosses the central axis 250 to exit the hollow body 220 generally aligned with the axis 232 and via the aperture 280. The flow of ions enters the second stage and hollow body 520 via the aperture 280 generally aligned with the axis 232. While in the hollow body 520, the ion beam crosses the axis 550 and exits generally aligned with axis 523. The ion beam passes through the aperture 580 into the cylindrical structure 552 for further transmission to additional stages or to the detector or analyzer.

By interposing the electrode 244, a direct sightline from the charged particle analyzer to the source of ions can be obscured or inhibited, while permitting both the source of ions and the charged particle analyzer to be offset from the central axes 250, 550 of the assembly on the same side in the y-direction.

Although the system is depicted as including two outer aperture plates 240, 544, in principle, the aperture plates 240, 544 can be omitted in some embodiments or replaced with grounded screens or shield grids. In such embodiments, the sightline between the exit region or charged particle analyzer and the ion source is obscured by the aperture plate 230 or other structure interposed between the first deflector stage and the second deflector stage, provided the size of the aperture 280 is offset relative to the central axes 250, 550 and does not exceed the radius of the hollow bodies 220, 520. For example, FIG. 5E is an isometric view of the system 500 in which the aperture plates 240, 544 and the aperture plate 230 have been replaced with grid electrodes 241, 545, 231, respectively.

Figure 5C:
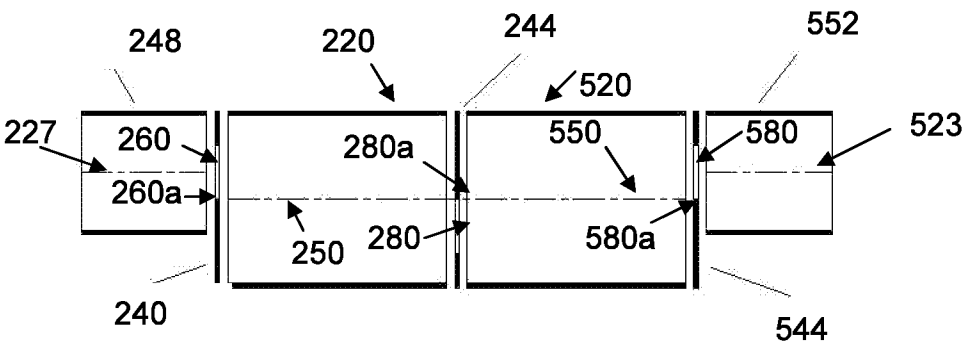
FIG. 5C is a cross-sectional view of the two-stage charged particle lens assembly of FIG. 5B.

FIG. 5C is a cross-sectional view of the two-stage charged particle lens assembly 500 of FIG. 5B. The diameter $d_c$ (discussed above with respect to FIG. 2C) of each of the cylindrical structures 248, 544 is greater than the size of the apertures 260, 580 in the y-direction. The central axis 250 of the hollow body 220 clips an edge 260*a* of the aperture and an edge 280*a* of the aperture 280*a*. The central axis 550 of the hollow body 520 clips the edge 280*a* of the aperture 280 and an edge 580*a* of the aperture 580. Because the central axes 250, 550 are generally aligned, there appears to be a straight-line through the assembly 500; however, the cylindrical structures 248, 552 are offset in the y-direction from the central axes 250, 550, thereby obscuring or inhibiting a direct sightline from the source to the detector. Additionally, in implementations where the charged particle source or the detector or analyzer have an aperture that is smaller in the y-direction than the apertures 260, 580, a sightline from the source to the detector or analyzer will be blocked.

When the incident ion beam is aligned with the axis 227, the central axis 250 does not intersect the ion beam within the incident-side cylindrical structure 248 (and the exit-side cylindrical structure 552 is obscured from the axis 227, the incident ion beam, and the source (not shown)) by the aperture plate 244. Similarly, when the exiting ion beam is aligned with the axis 523, the central axes 250, 550 do not intersect the ion beam within the exit-side cylindrical structure 552 (and the incident-side cylindrical structure 248 is obscured from the axis 523, the ion beam, and the exit region or charged particle analyzer (not shown)) by the aperture plate 244.

Figure 5D:
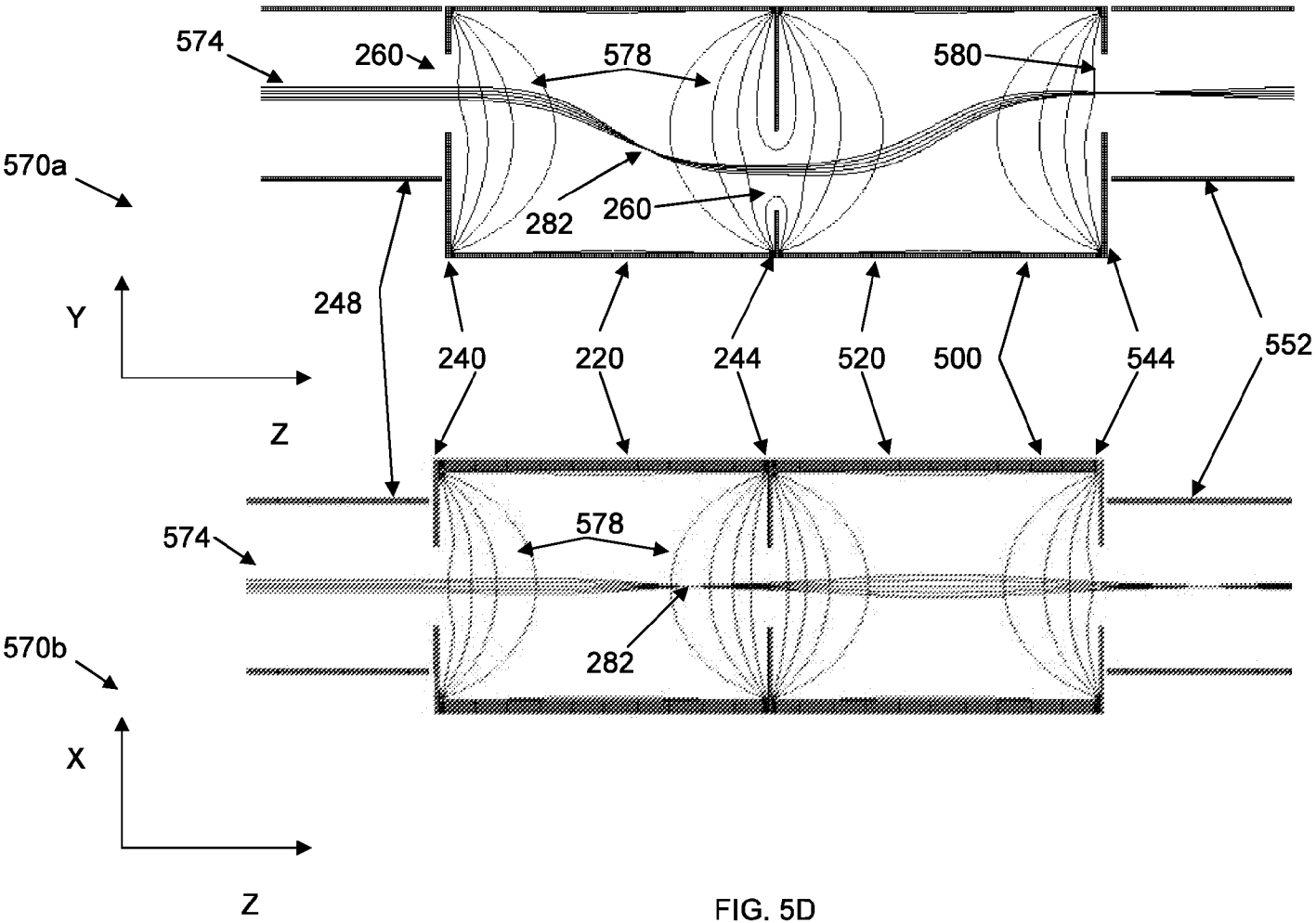
FIG. 5D is a schematic diagram of exemplary charged particle flow through the two-stage assembly of FIG. 5B, illustrated in two cross-sectional views.
Figure 5E:
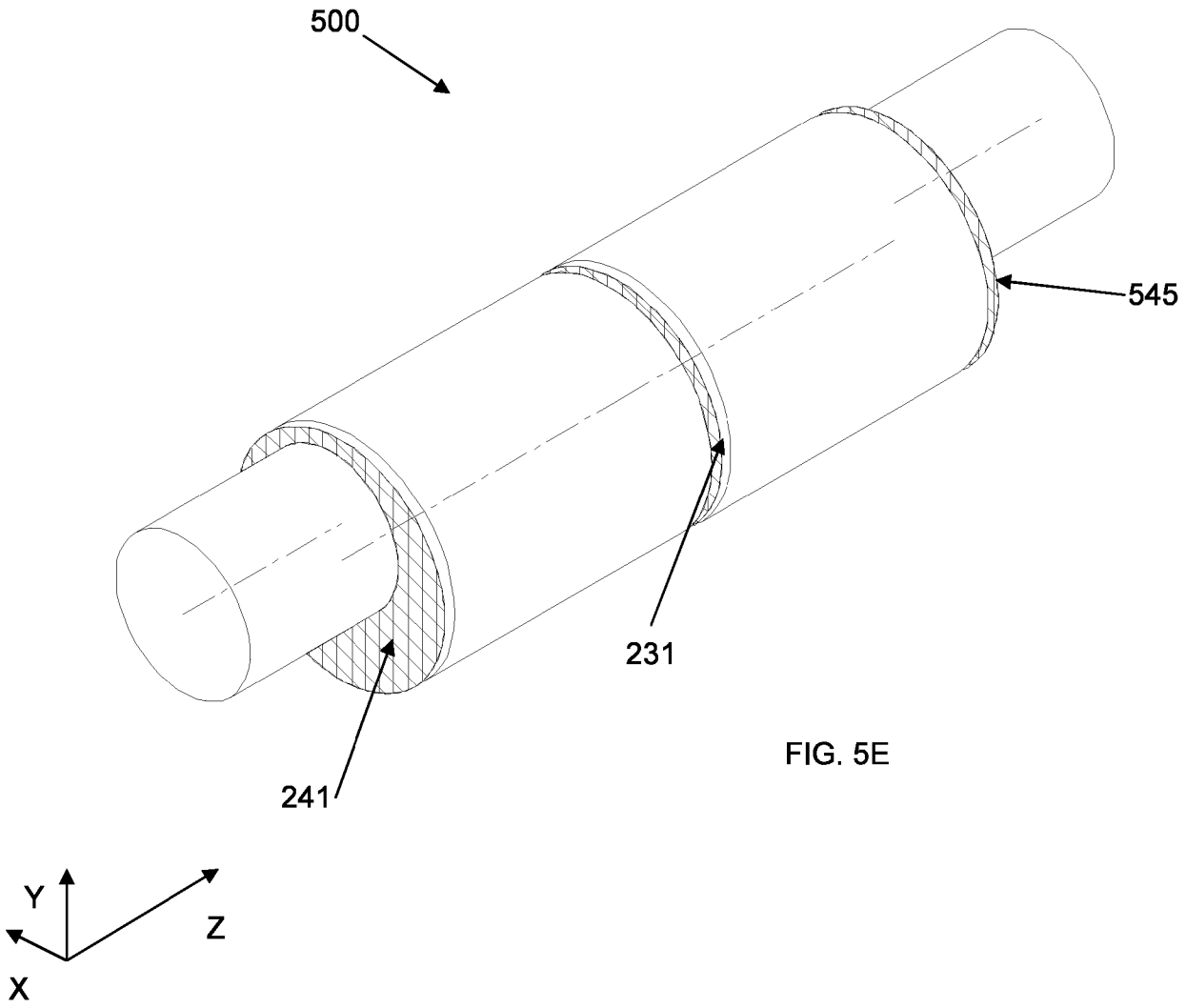
FIG. 5E is an isometric view of a two-stage charged particle lens assembly that includes shield grids as part of the electrode assemblies.

FIG. 5D is a schematic diagram of exemplary charged particle flow through the two-stage assembly 500 of FIG. 5B, illustrated in two views 570*a*-570*b*, based on a computer simulation. The view 570*a* depicts the flow of an ion beam 574 through the assembly 500 as it would appear in the y-z plane of FIG. 5B. The view 570*b* depicts the flow of the ion beam 574 through the assembly 500 as it would appear projected on the x-z plane of FIG. 5B. The view 570*b* represents a composite cross-section, constructed from five cross-sections parallel to the x-z plane along the axes 227, 250, 232, 550, and 523 respectively. Both views 570*a*-570*b* depict electric field lines 578 within the hollow body 220 and the hollow body 520 when an electric potential is applied to the hollow bodies 220, 520, and the aperture plates 240, 244, 544. FIG. 5D depicts exemplary field lines and flow of the ion beam 574 when the electric potential applied to the hollow bodies 220, 520 is 10V and the electric potential of the aperture plates 240, 244, 544 is 0V. The energy of the ion beam 574 is 10 eV.

The beam 574 is focused in both the y-z and x-z planes, but in both planes the focal point 282 extends beyond a midpoint of the hollow body 220. The focal point 282 can be shifted along the z axis by adjusting the electric potential applied to the electrodes 240, 244, and 280, for example to make the emerging beam less divergent.

Figure 6:
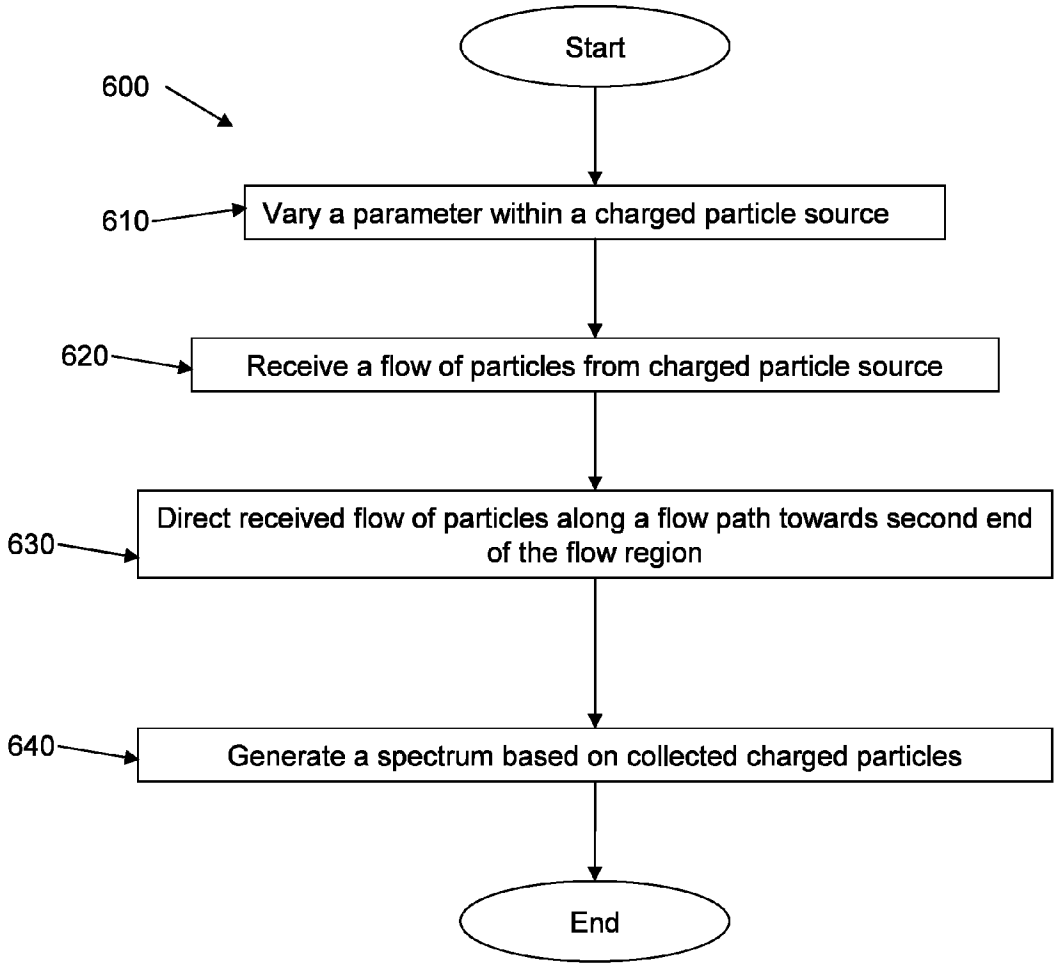
FIG. 6 is a flow chart of an exemplary process for changing a baseline offset of a charged particle analyzer.

FIG. 6 is a flow chart of an exemplary process 600 for changing a baseline offset of a charged particle analyzer. A parameter within a charged particle source is varied (e.g., the charged particle source 210 of FIG. 2) (Step 610). The parameter can be, e.g., pressure within the charged particle source and/or composition of species of particles within the charged particles source. During residual gas analysis ("RGA") of a trace species (e.g., gas species present which exhibit partial pressures of parts-per-million or parts-per-billion levels relative to the total pressure being measured) the main species (e.g., the gasses present at partial pressures which are relatively high percentage levels of the total pressure being measured) can change from one pure gas to another pure gas or a mixture of two or more gasses and the pressure can vary between more than 1 Pa to less than $1\times10^{-7}$ Pa during a single measurement. By way of example, a measurement may start with helium, air, or hydrogen as the major gas and change to argon or nitrogen during the course of the measurement. Other examples of major gas changes will be apparent to those of skill in the art.

The flow of particles is received from the charged particle source (Step 620). The flow of particles is received at a first site, for example an aperture, into a first end a flow region, for example, a hollow body, as described above in FIG. 2.

The flow of particles is directed through the flow region along a flow path towards a second site of a second end of the flow region (Step 630). The first site and the second site are spaced from an axis extending from the first end to the second of the flow region, for example, as described above in FIG. 2A. The second site is positioned such that a sightline that is parallel to a direction of the flow of particles at the first site does not intersect the second site. In some embodiments, the source of the flow of particles (e.g., charged particle or ion source) is not visible along a sightline at a position that is coincident with an entrance aperture of a charged particle analyzer (e.g., an analyzer) and through the flow region, such that neutral particles and particles with higher energies or lower energies than the average energy of the species to be analyzed do not pass from the ion source to the charged particle analyzer. The flow of particles can be directed by an electric potential (or a series or combination of electric potentials) applied to structures making up the flow region. The electric fields generated by the applied electric potentials cooperate to direct flow from the first site to the second site across a centerline of the flow region, as described above in FIG. 2A.

The charged particles can be collected with an analyzer or detector as the particles exit the flow region. A mass spectrum is generated based on collected charged particles (Step 640). In some embodiments, charged particles not having a desired charged particle energy are selectively directed out of the flow region such that the flow region functions as an energy filter. A flow of neutral species included in the flow of particles is obstructed or inhibited from flowing towards the second site of the flow region.

Figure 7:
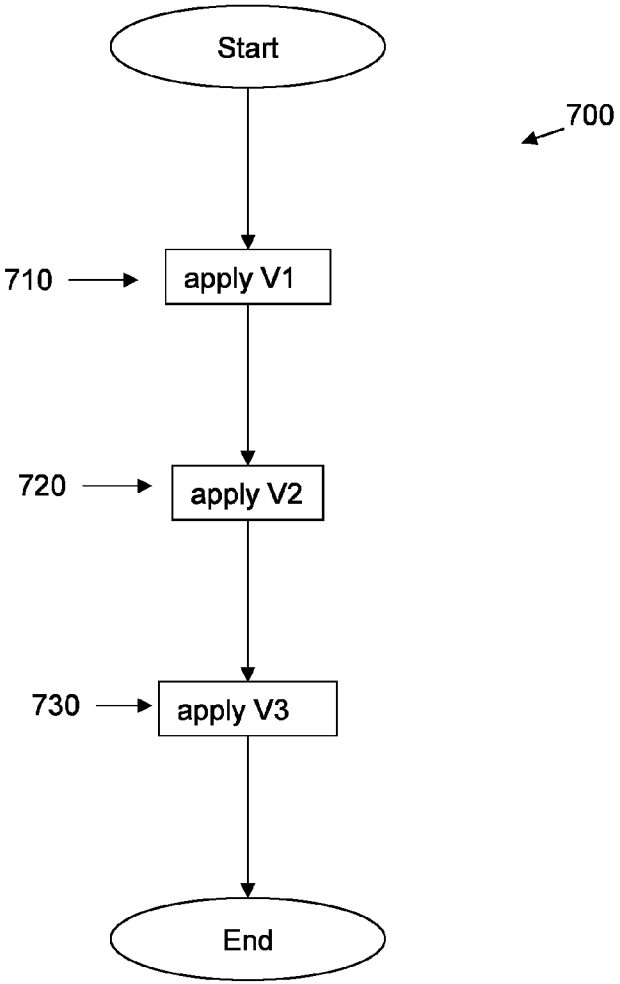
FIG. 7 is a flow chart of an exemplary process for inhibiting a sightline between a charged particle source and an input to a charged particle analyzer.

FIG. 7 is a flow chart 700 of an exemplary process for inhibiting a sightline between a charged particle source and an input to a charged particle analyzer.

The process begins when a first voltage (V1) is applied to a hollow body (e.g., the hollow body 220 of FIG. 2) (Step 710). The first voltage (V1) can be predetermined based on a species type of the charged particles to be analyzed and/or geometry of the hollow body, as discussed with respect to FIG. 4. The first voltage (V1), in cooperation with the electric potential supplied to other elements of the system establishes an electric field within the hollow body. The electric field directs a flow of charged particles through the hollow body along a desired flow path from an incident aperture spaced from a first axis of the hollow body to an exit aperture spaced from and/or reflected about the first axis.

A second voltage (V2) is applied to a first electrode assembly that is disposed relative to a first end of the hollow body (e.g., first electrode assembly 225 and first end 240, as described above in FIG. 2) (Step 720). The second voltage (V2), in cooperation with the first voltage V1, can direct the flow of charged particles from the charged particle source through the first electrode assembly towards and/or into the first end of the hollow body or the hollow body.

A third voltage (V3) is applied to a second electrode assembly that is disposed relative to a second end of the hollow body (e.g., the second end 245 of FIG. 2) (Step 730). The third voltage (V3), in cooperation with the first voltage (V1), can direct the flow of charged particles through the second electrode assembly into an analyzer or detector.

In practice, the values of V1, V2, and V3 are adjusted to optimize throughput of desired or desirable ions. The values of V1, V2, and V3 can be calculated or approximated using a charged-particle simulation computer program, and typical voltages are, for example, −60 Volts for V1, +3 Volts for V2, and −60 Volts for V3. In operation, the voltage values are determined by the geometry of the elements of the system. After an initial or simulation run, the values can be tuned experimentally to optimize throughput and performance.

The charged particle source and the charged particle analyzer can be disposed within a vacuum, near-vacuum, or low-pressure environment. In some embodiments, the charged particle source is separated from the charged particle analyzer by one or more differentially-pumped regions.

Figure 8:
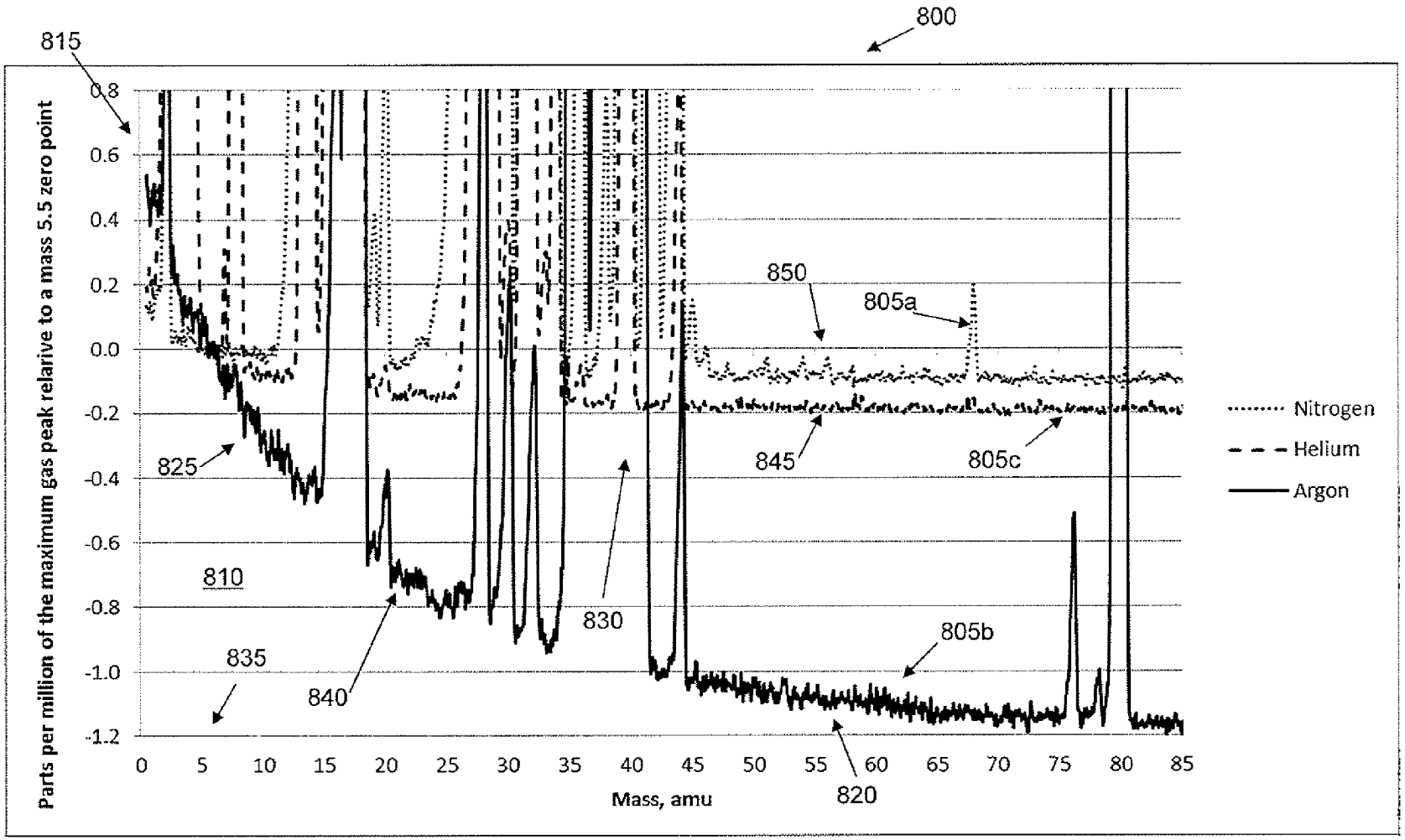
FIG. 8 is a graph of mass spectra for three species of nitrogen, argon and helium generated with a system that does not inhibit a sightline between a source and an analyzer.

FIG. 8 is a graph 800 of three mass spectra 805*a*-805*c* for species of nitrogen, argon, and helium, respectively, generated with a system that does not inhibit a sightline between a source and an analyzer. The mass spectra 805*a*-805*c* for nitrogen, argon, and helium, were observed at a constant pressure within the ion source. The mass spectra 805*a*-805*c* are represented as curves plotted on a graph 810 with parts per million of the maximum gas peak along the vertical axis 815 against mass (in atomic mass units (amu)) along the horizontal axis 820. Each curve can include both a baseline portion and one or more peaks (e.g., mass peaks). For example, the spectrum 805*b* for argon includes a baseline portion 825 and one or more peak portions 830. An operator can determine or manually establish a "zero" value 835 of mass along the vertical axis, depicted in FIG. 8 as 5.5 amu. For the argon spectrum 805*b*, the value of the baseline portion 825 at a mass of 10 amu is approximately −0.2 ppm relative to the signal measured at an arbitrary zero point of 5.5 amu. The baseline portion 825 of the spectrum 805*b* for argon decreases along a curved portion 840 until approximately a mass of 85 amu, at which point the baseline portion 825 of the spectrum 805*b* levels off. The spectrum 805*b* levels off when the mass concentration is approximately −1.2 ppm. Because the baseline portion 825 of the spectrum 805*b* for argon varies between about 0.2 ppm and −1.2 ppm, while mass varies between 0 amu and 85 amu, the baseline portion 825 of an output signal appears distorted. The baseline portion 845 of the spectrum 805*c* for helium varies between 0.1 and −0.15 ppm, and the baseline portion 850 of the spectrum 805*a* for nitrogen varies between 0.1 ppm and approximately −0.1 ppm. This offset in the baseline portions 825, 845, 850 can reduce accuracy of the output spectrum as a result of signal noise. Additionally, the baseline portion of the spectrum 805*b* for argon differs from the values in ppm for the baseline portions 845, 850 for the helium spectrum 805*c* and the nitrogen spectrum 805*a*, respectively, meaning that a baseline normalization using only one gas does not accurately represent the true baseline for a different gas. The different baselines would introduce errors (substantial errors, in some cases) in trace gas analysis without frequent re-normalization. Frequent re-normalization often results in inconvenience and delay.

Figure 9:
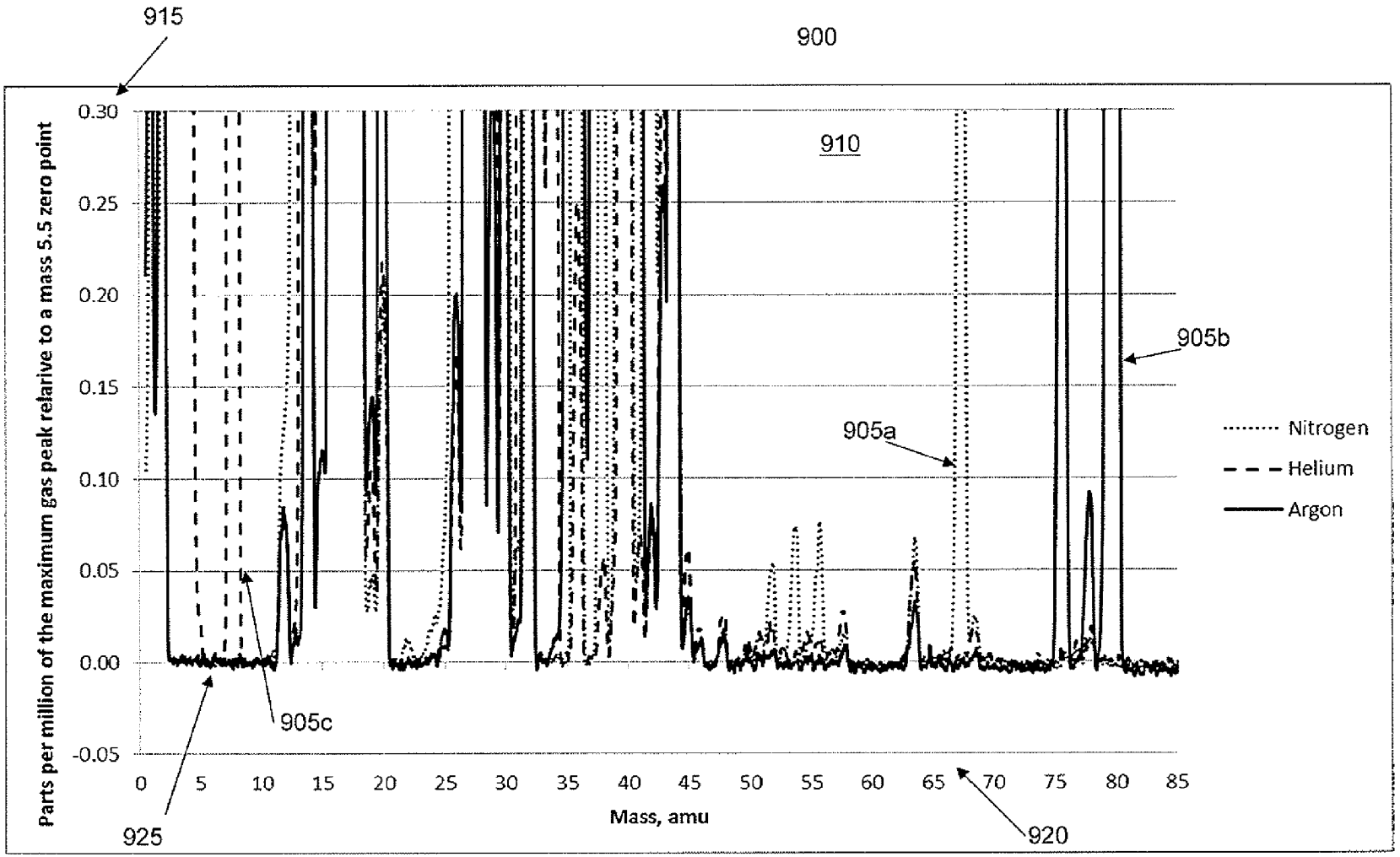
FIG. 9 is a graph of mass spectra for three species of nitrogen, argon and helium generated with a system that inhibits a sightline between a source and an analyzer.

FIG. 9 is a graph 900 of mass spectra 905*a*-905*c* for species of nitrogen, argon, and helium, respectively, generated with a system that inhibits or obscures a sightline between an ion source and a charged particle analyzer, as described herein. The mass spectra 905*a*-905*c* were observed at a constant pressure within the ion source. The mass spectra 905*a*-905*c* are represented as curves plotted on a graph 910 with parts-per-million of the maximum gas peak along the vertical axis 915 against mass (in atomic mass units (amu)) along the horizontal axis 920. In FIG. 9, the baseline portion 925 of each spectrum 905*a*-905*c* varies less than 0.01 ppm and is centered about 0.0 ppm across the mass range. As can be seen in FIG. 9, inhibiting a sightline between the source and charged particle analyzer minimizes the variance of the baseline portion 925 of the signals, and the curved portion 840 of FIG. 8 has been eliminated or substantially minimized. Additionally, the baseline portion of each spectrum 905*a*-905*c* is approximately equal, unlike the values of the baseline portions 825, 845, 850 of FIG. 8. The resulting spectra 905*a*-905*c* provide more robust output signals for analysis that are less influenced by noise from detection of unwanted photons, neutral particles, or undesirable species.

While the invention has been particularly shown and described with reference to specific embodiments, it should be understood by those skilled in the art that various changes in form and detail may be made therein without departing from the spirit and scope of the invention as defined by the appended claims.

The invention claimed is:

1. A charged particle lens assembly comprising:

a hollow body defining a first end, a second end and a first axis extending from the first end to the second end along a centerline of the hollow body, wherein the hollow body is substantially linear along the first axis and the hollow body has an aspect ratio of between 1.3 and 1.6 defined by a longitudinal length along the first axis divided by a diameter of the first end, the second end, or both;

a first electrode assembly positioned relative to the first end of the hollow body and defining a first aperture spaced from the first axis for receiving an incident beam of charged particles; and a second electrode assembly positioned relative to the second end of the hollow body and defining a second aperture spaced from the first axis for passing charged particles out of the lens assembly, the hollow body configured to, when an electric potential is applied, direct a supply of charged particles incident from the first aperture towards the second aperture for exiting the assembly while crossing at least a portion of the first axis.

2. The charged particle lens assembly of claim 1, wherein the first aperture is spaced from the first axis a distance substantially equal to a distance the second aperture is spaced from the first axis.

3. The charged particle lens assembly of claim 2, wherein the first aperture and the second aperture are positioned opposite with respect to the first axis.

4. The charged particle lens assembly of claim 1, wherein the hollow body has a circular cross section in a plane orthogonal to the first axis.

5. The charged particle lens assembly of claim 1, wherein the hollow body is cylindrically-shaped.

6. The charged particle lens assembly of claim 1, wherein the hollow body defines a geometry having mirror symmetry in a first plane perpendicular to the first axis and in a second plane that is substantially orthogonal to the first plane.

7. The charged particle lens assembly of claim 1, further comprising:

wherein the first electrode assembly comprises a first electrode defining a second axis substantially parallel to the first axis and substantially centered on the first aperture; and wherein the second electrode assembly comprises a second electrode defining a third axis substantially parallel to the first axis and substantially centered on the second aperture.

8. The charged particle lens assembly of claim 7 wherein a charged particle beam incident upon the first electrode travels through (a) the first electrode along at least a portion of the second axis, (b) the hollow body across a portion of the first axis and (c) the second electrode along at least a portion of the third axis.

9. The charged particle lens assembly of claim 7 wherein the first and second electrodes comprise grounded screens.

10. The charged particle lens assembly of claim 7 wherein the first and second electrodes comprise shield grids or aperture plates.

11. The charged particle lens assembly of claim 7 wherein the first electrode includes a circular aperture concentric with the second axis and the second electrode includes a circular aperture concentric with the third axis.

12. The charged particle lens assembly of claim 1 further comprising a means for applying the electric potential.

13. The charged particle lens assembly of claim 12 where the means for applying the electric potential comprises a power supply or an electrically-conductive material.

14. The charged particle lens assembly of claim 1 wherein the numerical value of the electrical potential applied, as represented in volts, is substantially equal to the numerical value of an average energy of the supply of charged particles, as represented in electron volts.

15. A system comprising:

an interface to a supply of charged particles having a variable pressure or gas composition;

a particle flow-direction structure in communication with the supply of charged particles, the charged particle flow-direction structure including (a) a hollow body defining a first end and a second end and a first axis extending from the first end to the second end along a centerline of the hollow body, wherein the hollow body is substantially linear along the first axis and the hollow body has an aspect ratio of between 1.3 and 1.6 defined by a longitudinal length along the first axis divided by a diameter of the first end, the second end, or both (b) a first electrode assembly positioned relative to the first end of the hollow body and a first aperture spaced from the first axis for receiving an incident supply of charged particles and (c) a second electrode assembly positioned relative to the second end of the hollow body and a second aperture spaced from the first axis, the hollow body configured to, when an electric potential is applied, direct a supply of charged particles incident from the first electrode assembly towards the second electrode assembly while crossing at least a portion of the first axis; and a charged particle analyzer module in communication with the particle flow-direction structure and positioned relative to the second electrode assembly to receive a flow of charged particles exiting the particle flow-direction structure.

16. The system of claim 15 wherein the charged particle analyzer module is in fluid communication with, electrical communication with, or both fluid and electrical communication with the particle flow-direction structure.

17. The system of claim 15 wherein the charged particle analyzer module comprises at least a portion of the second electrode assembly.

18. A system comprising:

means for interfacing to a supply of charged particles having a variable pressure or gas composition;

particle flow-direction means for directing a flow of particles received from the means for interfacing at a first electrode assembly via a first aperture along a flow path through a hollow body toward a second electrode assembly adjacent a second aperture, the first aperture and second aperture spaced from an axis extending from a first end to a second end of the hollow body along a centerline of the hollow body, the hollow body being substantially linear along the first axis and has an aspect ratio of between 1.3 and 1.6 defined by a longitudinal length along the first axis divided by a diameter of the first end, the second end, or both, the flow path defined at least in part by an electric potential applied to the hollow body and is adapted to cross at least a portion of the first axis; and charged particle analyzer means in communication with the particle flow-direction means for collecting and analyzing a flow of charged particles from the particle flow-direction means.

* * * * *